US007327211B2

(12) United States Patent
Ruan et al.

(10) Patent No.: US 7,327,211 B2
(45) Date of Patent: Feb. 5, 2008

(54) MICRO-MAGNETIC LATCHING SWITCHES WITH A THREE-DIMENSIONAL SOLENOID COIL

(75) Inventors: Meichun Ruan, Tempe, AZ (US); Cheng Ping Wei, Gilbert, AZ (US); Jun Shen, Phoenix, AZ (US)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 11/084,864

(22) Filed: Mar. 21, 2005

(65) Prior Publication Data

US 2006/0049900 A1 Mar. 9, 2006

Related U.S. Application Data

(63) Continuation of application No. 10/216,663, filed on Aug. 12, 2002, now abandoned, which is a continuation-in-part of application No. 10/051,447, filed on Jan. 18, 2002, now Pat. No. 6,794,965.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 4,065,677 A 12/1977 Micheron et al.
4,161,685 A 7/1979 Jacob
4,461,968 A 7/1984 Kolm et al.
4,496,211 A 1/1985 Daniel
4,570,139 A 2/1986 Kroll (Continued)

FOREIGN PATENT DOCUMENTS

DE 19820821 C1 12/1999

(Continued)

OTHER PUBLICATIONS

Richard P. Feymann, "There's Plenty of Room at the Bottom", Dec. 29, 1959, pp. 1-12, Internet Source: http://222.xyvex.com/nanotech/feynman.html.

(Continued)

*Primary Examiner*—Elvin Enad
*Assistant Examiner*—Bernard Rojas
(74) *Attorney, Agent, or Firm*—Sterne, Kessler, Goldstein & Fox, PLLC

(57) ABSTRACT

A micro-machined magnetic latching switch is described. A moveable micro-machined cantilever has a magnetic material and a longitudinal axis. The cantilever has a conducting layer. A permanent magnet produces a first magnetic field, which induces a magnetization in the magnetic material. The magnetization is characterized by a magnetization vector pointing in a direction along the longitudinal axis of the cantilever. The first magnetic field is approximately perpendicular to longitudinal axis. A three-dimensional solenoid coil produces a second magnetic field to switch the cantilever between a first stable state and a second stable state. The temporary current is input to the three-dimensional solenoid coil, producing the second magnetic field such that a component of the second magnetic field parallel to the longitudinal axis changes direction of the magnetization vector. The cantilever is thereby caused to switch between the first stable state and the second stable state.

17 Claims, 23 Drawing Sheets

U.S. PATENT DOCUMENTS

| | | | |
|---|---|---|---|
| 5,016,978 | A | 5/1991 | Fargette et al. |
| 5,048,912 | A | 9/1991 | Kunikane et al. |
| 5,398,011 | A | 3/1995 | Kimura et al. |
| 5,472,539 | A | 12/1995 | Saia et al. |
| 5,475,353 | A | 12/1995 | Roshen et al. |
| 5,557,132 | A | 9/1996 | Takahashi |
| 5,629,918 | A | 5/1997 | Ho et al. |
| 5,696,619 | A | 12/1997 | Knipe et al. |
| 5,784,190 | A | 7/1998 | Worley |
| 5,818,316 | A | 10/1998 | Shen et al. |
| 5,838,847 | A | 11/1998 | Pan et al. |
| 5,847,631 | A | 12/1998 | Taylor et al. |
| 5,898,515 | A | 4/1999 | Furlani et al. |
| 5,909,069 | A | 6/1999 | Allen et al. |
| 5,945,898 | A | 8/1999 | Judy et al. |
| 5,982,554 | A | 11/1999 | Goldstein et al. |
| 6,016,092 | A | 1/2000 | Qiu et al. |
| 6,016,095 | A | 1/2000 | Herbert |
| 6,025,767 | A | 2/2000 | Kellam et al. |
| 6,028,689 | A | 2/2000 | Michalicek et al. |
| 6,031,652 | A | 2/2000 | Furlani et al. |
| 6,078,016 | A | 6/2000 | Yoshikawa et al. |
| 6,084,281 | A | 7/2000 | Fullin et al. |
| 6,094,116 | A | 7/2000 | Tai et al. |
| 6,094,293 | A | 7/2000 | Yokoyama et al. |
| 6,115,231 | A | 9/2000 | Shirakawa |
| 6,124,650 | A | 9/2000 | Bishop et al. |
| 6,143,997 | A | 11/2000 | Feng et al. |
| 6,160,230 | A | 12/2000 | McMillan et al. |
| 6,171,886 | B1 | 1/2001 | Ghosh et al. |
| 6,310,526 | B1 | 10/2001 | Yip et al. |
| 6,366,186 | B1 | 4/2002 | Hill et al. |
| 6,410,360 | B1 | 6/2002 | Steenberge |
| 6,469,602 | B2 | 10/2002 | Ruan et al. |
| 6,469,603 | B1 | 10/2002 | Ruan et al. |
| 6,496,612 | B1 | 12/2002 | Ruan et al. |
| 6,633,212 | B1 | 10/2003 | Ruan et al. |
| 6,639,493 | B2 | 10/2003 | Shen et al. |
| 6,794,965 | B2 | 9/2004 | Shen et al. |
| 7,023,304 | B2 | 4/2006 | Shen et al. |
| 7,027,682 | B2 | 4/2006 | Ruan et al. |
| 7,071,431 | B2 | 7/2006 | Ruan et al. |
| 2002/0181886 | A1 | 12/2002 | Fischer et al. |
| 2002/0196110 | A1 | 12/2002 | Vaitkus et al. |
| 2002/0196112 | A1 | 12/2002 | Ruan et al. |
| 2003/0030998 | A1 | 2/2003 | Mhani et al. |
| 2003/0137374 | A1 | 7/2003 | Ruan et al. |

FOREIGN PATENT DOCUMENTS

| | | | |
|---|---|---|---|
| DE | 10031569 | A1 | 2/2001 |
| EP | 0452012 | A2 | 10/1991 |
| EP | 0452012 | A3 | 10/1991 |
| EP | 0685864 | A1 | 12/1995 |
| EP | 0709911 | A2 | 5/1996 |
| EP | 0709911 | A3 | 5/1996 |
| EP | 0780858 | A1 | 6/1997 |
| EP | 0887879 | A1 | 6/1998 |
| EP | 0869519 | A1 | 10/1998 |
| FR | 2572546 | A1 | 5/1986 |
| JP | 54-161952 | | 12/1979 |
| JP | 4-275519 | | 10/1992 |
| JP | 6-251684 | | 9/1994 |
| WO | WO97/39468 | | 10/1997 |
| WO | WO98/34269 | | 8/1998 |
| WO | WO9927548 | | 6/1999 |
| WO | WO 01/57899 | A1 | 8/2001 |
| WO | WO 01/84211 | A2 | 11/2001 |
| WO | WO 02/05012 | A2 | 1/2002 |
| WO | WO 02/058092 | A1 | 7/2002 |
| WO | WO 02/080207 | A1 | 10/2002 |

OTHER PUBLICATIONS

E. Fullin, J. Gobet, H.A.C. Tilmans, and J. Bergvist, "A New Basic Technology for Magnetic Micro-Actuators", pp. 143-147.

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: http://www-bsac.eecs.berkeley.edu/Kruglick/relays/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: http://scitec.uwhichill.edu.bb/cmp/online/P10D/Lecture14/lect14.htn, Jan. 3, 2000, pp. 1-5.

"Ultraminiature Magnetic Latching to 5-relays SPDT DC to C Band", Series RF 341, product information from Teledyne Relays, 1998.

M. Ruan et al., "Latching Microelectromagnetic Relays", Sensors and Actuators A 91 (Jul. 15, 2001), Copyright 2001 Elsevier Science B.V., pp. 346-350.

Xi-Qing Sun, K.R. Farmer, W.N. Carr, "A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Sources: http://home.earthlink.net/-trimmerw/mems/scale.html on Jan. 3, 2000 (adapted from article Microbots and Micromechanical Systems by W.S.N. Trimmer, Sensors and Actuators, vol. 19, No. 3, Sep. 1989, pp. 267-287, and other sources).

John A. Wright amd Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lillenthal, "A Magnetostatic MEMS Switch for DC Brushless Motor Commutation", Proceedings Solid State Sensor and Actuator Workshop, Hilton Head, 1998, Jun. 1998, pp. 304-307.

John A. Wright, Yu-Chong Tai, and Shih-Chia Chang, "A Large-Force, Fully-Integrated MEMS Magnetic Actuator", Transducers '97, 1997 International Conference on Solid State Sensors and Actuators, Chicago, Jun. 16-19, 1997.

Ann, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.
English-Language Abstract of DE 19820821, published Dec. 16, 1999, 1 page.
English-Language Abstract of EP 0780858, published Jun. 25, 1997, 1 page.
English-Language Abstract of EP 0869519, published Oct. 7, 1998, 1 page.
English-Language Abstract of FR 2572546, published May 2, 1986, 1 page.
English-Language Abstract of JP 4275519, published Oct. 1, 1992, 1 page.
English-Language Abstract of JP 6251684, published Sep. 9, 1994, 1 page.
English-Language Abstract of JP 54161952, published Dec. 22, 1979, 1 page.
English-Language Abstract of WO 9927548, published Jun. 3, 1999, 1 page.
Ruan et al., "Electronically Switching Latching Micro-Magnetic Relay and Method of Operating Same", U.S. Appl. No. 09/961,382, filed Sep. 25, 2001.
International Search Report; PCT/US02/01359; Jun. 5, 2002; 3 pgs.
International Search Report; PCT/US02/09905; Jul. 16, 2002; 3 pgs.

MICRO-MAGNETIC LATCHING SWITCHES WITH A THREE-DIMENSIONAL SOLENOID COIL

CROSS-REFERENCE TO RELATED APPLICATIONS

This application is a continuation of U.S. Application Ser. No. 10/216,663, filed Aug. 12, 2002, now abandoned, which is a continuation-in-part of Application No. 10/051,447, filed Jan. 18, 2002, now U.S. Pat. No. 6,794,965, which are both herein incorporated by reference in their entirety.

BACKGROUND OF THE INVENTION

1. Field of the Invention

The present invention relates to electronic and optical switches. More specifically, the present invention relates to micro-magnetic latching switches using a magnetic actuation mechanism.

2. Background Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that energizes an armature to make or break an electrical contact. When the magnet is de-energized, a spring or other mechanical force typically restores the armature to a quiescent position. Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micro-magnetic relays may degrade or break over time.

Non-latching micro-magnetic relays are known. The relay includes a permanent magnet and an electromagnet for generating a magnetic field that intermittently opposes the field generated by the permanent magnet. The relay must consume power in the electromagnet to maintain at least one of the output states. Moreover, the power required to generate the opposing field would be significant, thus making the relay less desirable for use in space, portable electronics, and other applications that demand low power consumption.

The basic elements of a latching micro-magnetic switch include a permanent magnet, a substrate, a coil, and a cantilever at least partially made of soft magnetic materials. In its optimal configuration, the permanent magnet produces a static magnetic field that is relatively perpendicular to the horizontal plane of the cantilever. However, the magnetic field lines produced by a permanent magnet with a typical regular shape (disk, square, etc.) are not necessarily perpendicular to a plane, especially at the edge of the magnet. Then, any horizontal component of the magnetic field due to the permanent magnet can either eliminate one of the bistable states, or greatly increase the current that is needed to switch the cantilever from one state to the other. Careful alignment of the permanent magnet relative to the cantilever so as to locate the cantilever in the right spot of the permanent magnet field (usually near the center) will permit bi-stability and minimize switching current. Nevertheless, high-volume production of the switch can become difficult and costly if the alignment error tolerance is small.

What is desired is a bi-stable, latching switch with relaxed permanent magnet alignment requirements and reduced power requirements. Such a switch should also be reliable, simple in design, low-cost and easy to manufacture, and should be useful in optical and/or electrical environments.

BRIEF SUMMARY OF THE INVENTION

Micro-machined latching switches having enhanced electrical and mechanical characteristics, and methods for operating the same, are described. In one aspect, a micro-machined magnetic latching switch is described. A moveable micro-machined cantilever has a magnetic material and a longitudinal axis. The cantilever has a conducting layer. A permanent magnet produces a first magnetic field, which induces a magnetization in the magnetic material. The magnetization is characterized by a magnetization vector pointing in a direction along the longitudinal axis of the cantilever. The first magnetic field is approximately perpendicular to longitudinal axis. A three-dimensional solenoid coil produces a second magnetic field to switch the cantilever between a first stable state and a second stable state. The temporary current is input to the three-dimensional solenoid coil, producing the second magnetic field such that a component of the second magnetic field parallel to the longitudinal axis changes direction of the magnetization vector. The cantilever is thereby caused to switch between the first stable state and the second stable state.

In a further aspect, the three-dimensional solenoid coil includes a magnetic core and a coil line wrapped at least once around said magnetic core.

In a further aspect, the temporary current is input to flow through the coil line around the magnetic core in a first direction in the first stable state. The temporary current is input to flow through the coil line around the magnetic core in a second direction in the second stable state.

In a still further aspect, the three-dimensional solenoid coil further includes an insulator. The coil line is insulated from the magnetic core by the insulator.

In another aspect, the three-dimensional solenoid coil includes a first layer, a second layer, and a third layer. A first portion of the coil line is insulated by the first layer. A second portion of the coil line is insulated by the third layer. The magnetic core forms the second layer between the first layer and the third layer.

In a further aspect, the first layer includes a first insulator. The first portion of the coil line is separated from the second layer by the first insulator. The third layer includes a second insulator portion. The second portion of the coil line is separated from the second layer by the second insulator.

In a still further aspect, the magnetic core is a permalloy.

These and other objects, advantages and features will become readily apparent in view of the following detailed description of the invention.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 1A:
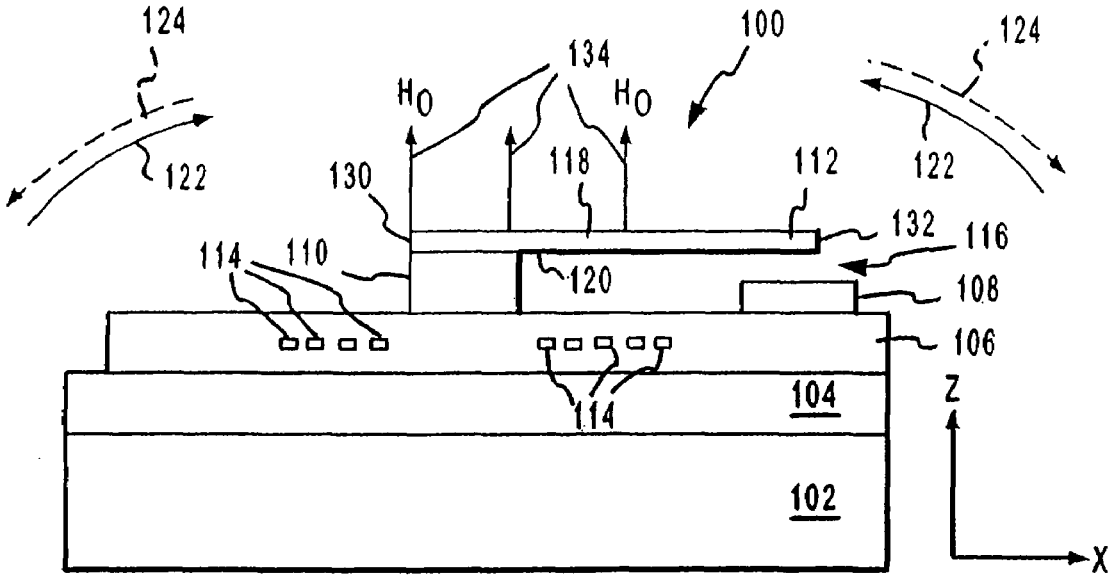
FIGS. 1A and 1B are side and top views, respectively, of an exemplary embodiment of a switch.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

It should be appreciated that the particular implementations shown and described herein are examples of the invention and are not intended to otherwise limit the scope of the present invention in any way. Indeed, for the sake of brevity, conventional electronics, manufacturing, MEMS technologies and other functional aspects of the systems (and components of the individual operating components of the systems) may not be described in detail herein. Furthermore, for purposes of brevity, the invention is frequently described herein as pertaining to a micro-electronically-machined relay for use in electrical or electronic systems. It should be appreciated that many other manufacturing techniques could be used to create the relays described herein, and that the techniques described herein could be used in mechanical relays, optical relays or any other switching device. Further, the techniques would be suitable for application in electrical systems, optical systems, consumer electronics, industrial electronics, wireless systems, space applications, or any other application.

The terms, chip, integrated circuit, monolithic device, semiconductor device, and microelectronic device, are often used interchangeably in this field. The present invention is applicable to all the above as they are generally understood in the field.

The terms metal line, transmission line, interconnect line, trace, wire, conductor, signal path and signaling medium are all related. The related terms listed above, are generally interchangeable, and appear in order from specific to general. In this field, metal lines are sometimes referred to as traces, wires, lines, interconnect or simply metal. Metal lines, generally aluminum (Al), copper (Cu) or an alloy of Al and Cu, are conductors that provide signal paths for coupling or interconnecting, electrical circuitry. Conductors other than metal are available in microelectronic devices. Materials such as doped polysilicon, doped single-crystal silicon (often referred to simply as diffusion, regardless of whether such doping is achieved by thermal diffusion or ion implantation), titanium (Ti), molybdenum (Mo), and refractory metal silicides are examples of other conductors.

The terms contact and via, both refer to structures for electrical connection of conductors from different interconnect levels. These terms are sometimes used in the art to describe both an opening in an insulator in which the structure will be completed, and the completed structure itself. For purposes of this disclosure contact and via refer to the completed structure.

The term vertical, as used herein, means substantially orthogonal to the surface of a substrate. Moreover, it should be understood that the spatial descriptions (e.g., "above", "below", "up", "down", "top", "bottom", etc.) made herein are for purposes of illustration only, and that practical latching relays can be spatially arranged in any orientation or manner.

The above-described micro-magnetic latching switch is further described in international patent publications WO0157899 (titled Electronically Switching Latching Micro-magnetic Relay And Method of Operating Same), and WO0184211 (titled Electronically Micro-magnetic latching switches and Method of Operating Same), to Shen et al. These patent publications provide a thorough background on micro-magnetic latching switches and are incorporated herein by reference in their entirety. Moreover, the details of the switches disclosed in WO0157899 and WO0184211 are applicable to implement the switch embodiments of the present invention as described below.

Overview of a Latching Switch

Figure 1B:
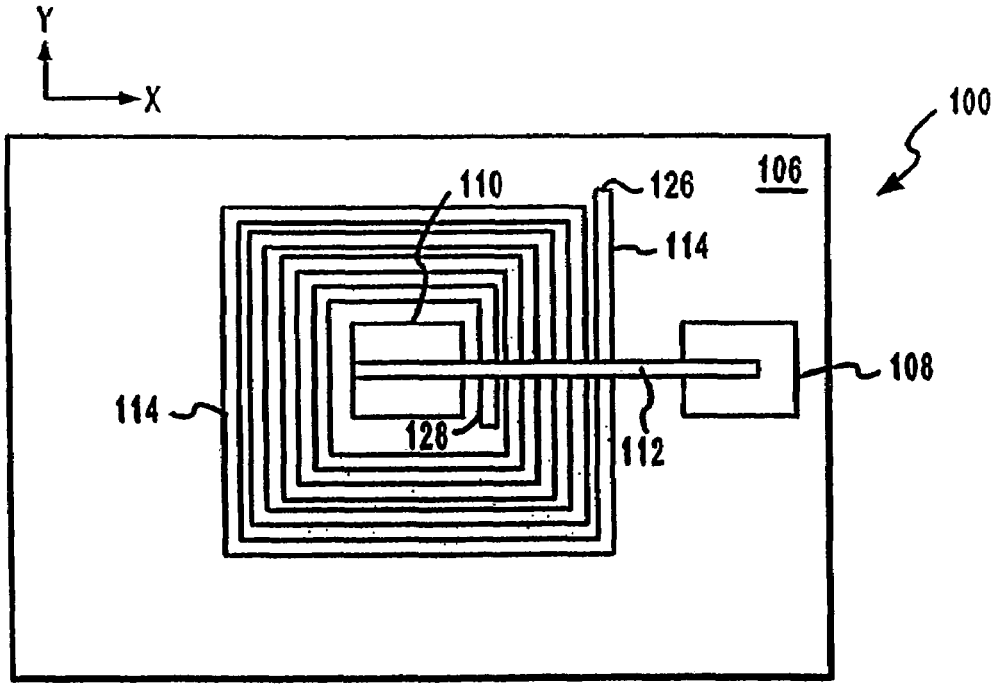

FIGS. 1A and 1B show side and top views, respectively, of a latching switch. The terms switch and device are used herein interchangeably to described the structure of the present invention. With reference to FIGS. 1A and 1B, an exemplary latching relay 100 suitably includes a magnet 102, a substrate 104, an insulating layer 106 housing a conductor 114, a contact 108 and a cantilever (moveable element) 112 positioned or supported above substrate by a staging layer 110.

Magnet 102 is any type of magnet such as a permanent magnet, an electromagnet, or any other type of magnet capable of generating a magnetic field $H_0$ 134, as described more fully below. By way of example and not limitation, the magnet 102 can be a model 59-P09213T001 magnet available from the Dexter Magnetic Technologies corporation of Fremont, Calif., although of course other types of magnets could be used. Magnetic field 134 can be generated in any manner and with any magnitude, such as from about 1 Oersted to $10^4$ Oersted or more. The strength of the field depends on the force required to hold the cantilever in a given state, and thus is implementation dependent. In the exemplary embodiment shown in FIG. 1A, magnetic field $H_0$ 134 can be generated approximately parallel to the Z axis and with a magnitude on the order of about 370 Oersted, although other embodiments will use varying orientations and magnitudes for magnetic field 134. In various embodiments, a single magnet 102 can be used in conjunction with a number of relays 100 sharing a common substrate 104.

Substrate 104 is formed of any type of substrate material such as silicon, gallium arsenide, glass, plastic, metal or any other substrate material. In various embodiments, substrate 104 can be coated with an insulating material (such as an oxide) and planarized or otherwise made flat. In various embodiments, a number of latching relays 100 can share a single substrate 104. Alternatively, other devices (such as transistors, diodes, or other electronic devices) could be formed upon substrate 104 along with one or more relays 100 using, for example, conventional integrated circuit manufacturing techniques. Alternatively, magnet 102 could be used as a substrate and the additional components discussed below could be formed directly on magnet 102. In such embodiments, a separate substrate 104 may not be required.

Insulating layer 106 is formed of any material such as oxide or another insulator such as a thin-film insulator. In an exemplary embodiment, insulating layer is formed of Probimide 7510 material. Insulating layer 106 suitably houses conductor 114. Conductor 114 is shown in FIGS. 1A and 1B to be a single conductor having two ends 126 and 128 arranged in a coil pattern. Alternate embodiments of conductor 114 use single or multiple conducting segments arranged in any suitable pattern such as a meander pattern, a serpentine pattern, a random pattern, or any other pattern. Conductor 114 is formed of any material capable of conducting electricity such as gold, silver, copper, aluminum, metal or the like. As conductor 114 conducts electricity, a magnetic field is generated around conductor 114 as discussed more fully below.

Cantilever (moveable element) 112 is any armature, extension, outcropping or member that is capable of being affected by magnetic force. In the embodiment shown in FIG. 1A, cantilever 112 suitably includes a magnetic layer 118 and a conducting layer 120. Magnetic layer 118 can be formulated of permalloy (such as NiFe alloy) or any other magnetically sensitive material. Conducting layer 120 can be formulated of gold, silver, copper, aluminum, metal or any other conducting material. In various embodiments, cantilever 112 exhibits two states corresponding to whether relay 100 is "open" or "closed", as described more fully below. In many embodiments, relay 100 is said to be "closed" when a conducting layer 120, connects staging layer 110 to contact 108. Conversely, the relay may be said to be "open" when cantilever 112 is not in electrical contact with contact 108. Because cantilever 112 can physically move in and out of contact with contact 108, various embodiments of cantilever 112 will be made flexible so that cantilever 112 can bend as appropriate. Flexibility can be created by varying the thickness of the cantilever (or its various component layers), by patterning or otherwise making holes or cuts in the cantilever, or by using increasingly flexible materials.

Alternatively, cantilever 112 can be made into a "hinged" arrangement. Although of course the dimensions of cantilever 112 can vary dramatically from implementation to implementation, an exemplary cantilever 112 suitable for use in a micro-magnetic relay 100 can be on the order of 10-1000 microns in length, 1-40 microns in thickness, and 2-600 microns in width. For example, an exemplary cantilever in accordance with the embodiment shown in FIGS. 1A and 1B can have dimensions of about 600 microns×10 microns×50 microns, or 1000 microns×600 microns×25 microns, or any other suitable dimensions.

Contact 108 and staging layer 110 are placed on insulating layer 106, as appropriate. In various embodiments, staging layer 110 supports cantilever 112 above insulating layer 106, creating a gap 116 that can be vacuum or can become filled with air or another gas or liquid such as oil. Although the size of gap 116 varies widely with different implementations, an exemplary gap 116 can be on the order of 1-100 microns, such as about 20 microns, Contact 108 can receive cantilever 112 when relay 100 is in a closed state, as described below. Contact 108 and staging layer 110 can be formed of any conducting material such as gold, gold alloy, silver, copper, aluminum, metal or the like. In various embodiments, contact 108 and staging layer 110 are formed of similar conducting materials, and the relay is considered to be "closed" when cantilever 112 completes a circuit between staging layer 110 and contact 108. In certain embodiments wherein cantilever 112 does not conduct electricity, staging layer 110 can be formulated of non-conducting material such as Probimide material, oxide, or any other material. Additionally, alternate embodiments may not require staging layer 110 if cantilever 112 is otherwise supported above insulating layer 106.

Principle of Operation of a Micro-Magnetic Latching Switch

When it is in the "down" position, the cantilever makes electrical contact with the bottom conductor, and the switch is "on" (also called the "closed" state). When the contact end is "up", the switch is "off" (also called the "open" state). These two stable states produce the switching function by the moveable cantilever element. The permanent magnet holds the cantilever in either the "up" or the "down" position after switching, making the device a latching relay. A current is passed through the coil (e.g., the coil is energized) only during a brief (temporary) period of time to transition between the two states.

(i) Method to Produce Bi-stability

Figure 2:
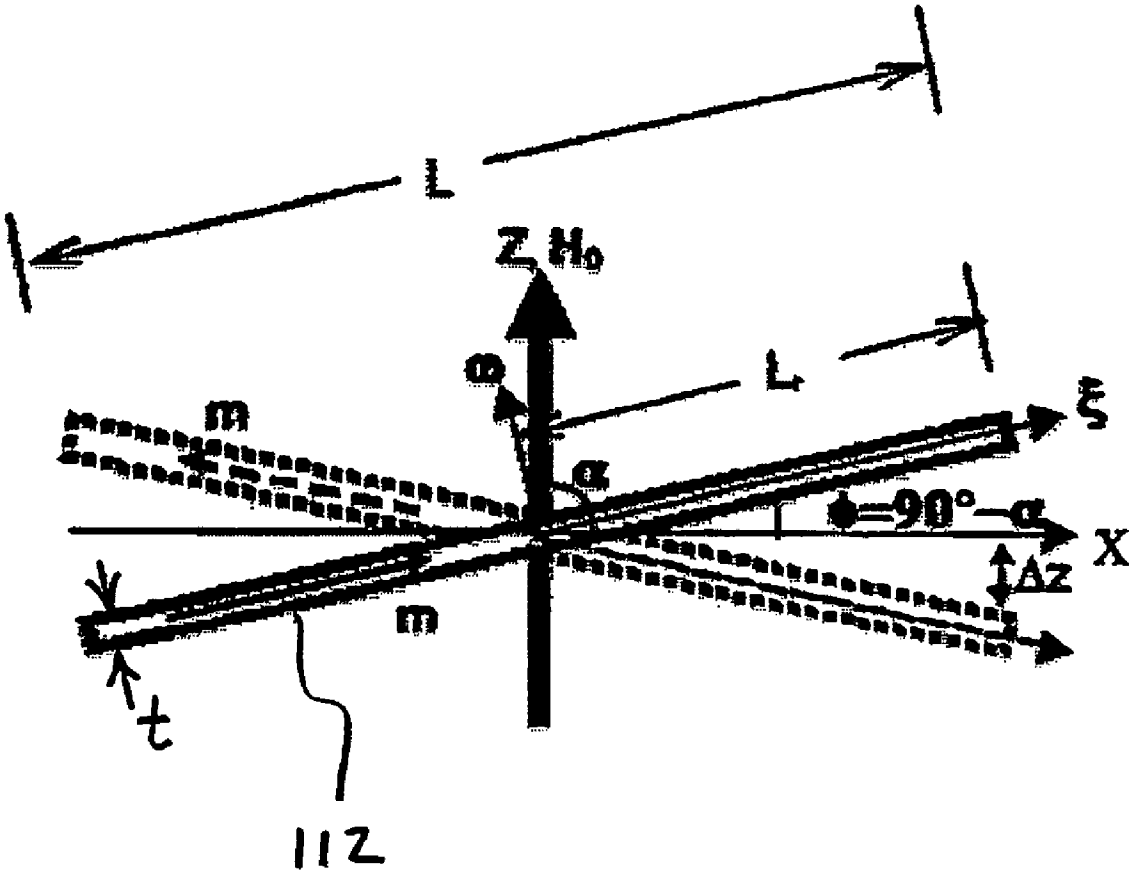
FIG. 2 illustrates the principle by which bi-stability is produced.

The principle by which bi-stability is produced is illustrated with reference to FIG. 2. When the length L of a permalloy cantilever 112 is much larger than its thickness t and width (w, not shown), the direction along its long axis L becomes the preferred direction for magnetization (also called the "easy axis"). When a major central portion of the cantilever is placed in a uniform permanent magnetic field, a torque is exerted on the cantilever. The torque can be either clockwise or counterclockwise, depending on the initial orientation of the cantilever with respect to the magnetic field. When the angle ($\alpha$) between the cantilever axis ($\xi$) and the external field ($H_0$) is smaller than 90°, the torque is counterclockwise; and when $\alpha$ is larger than 90°, the torque is clockwise. The bi-directional torque arises because of the bi-directional magnetization (i.e., a magnetization vector "m" points one direction or the other direction, as shown in FIG. 2) of the cantilever (m points from left to right when $\alpha<90°$, and from right to left when $\alpha>90°$). Due to the torque, the cantilever tends to align with the external magnetic field ($H_0$). However, when a mechanical force (such as the elastic torque of the cantilever, a physical stopper, etc.) preempts to the total realignment with $H_0$, two stable positions ("up" and "down") are available, which forms the basis of latching in the switch.

(ii) Electrical Switching

If the bi-directional magnetization along the easy axis of the cantilever arising from $H_0$ can be momentarily reversed by applying a second magnetic field to overcome the influence of ($H_0$), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the ξ-component (along the cantilever, see FIG. 2) of this field that is used to reorient the magnetization (magnetization vector "m") in the cantilever. The direction of the coil current determines whether a positive or a negative ξ-field component is generated. Plural coils can be used. After switching, the permanent magnetic field holds the cantilever in this state until the next switching event is encountered. Since the ξ-component of the coil-generated field (Hcoil-ξ) only needs to be momentarily larger than the ξ-component [$H_0\xi \sim H_0 \cos(\alpha)=H_0 \sin(\phi)$, $\alpha=90°-\phi$] of the permanent magnetic field and $\phi$ is typically very small (e.g., $\phi \leqq 5°$), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bi-stable states are possible when other forces can balance the torque. A coil can generate a momentary magnetic field to switch the orientation of magnetization (vector m) along the cantilever and thus switch the cantilever between the two states.

Relaxed Alignment of Magnets

To address the issue of relaxing the magnet alignment requirement, the inventors have developed a technique to create perpendicular magnetic fields in a relatively large region around the cantilever. The invention is based on the fact that the magnetic field lines in a low permeability media (e.g., air) are basically perpendicular to the surface of a very high permeability material (e.g., materials that are easily magnetized, such as permalloy). When the cantilever is placed in proximity to such a surface and the cantilever's horizontal plane is parallel to the surface of the high permeability material, the above stated objectives can be at least partially achieved. The generic scheme is described below, followed by illustrative embodiments of the invention.

The boundary conditions for the magnetic flux density (B) and magnetic field (H) follow the following relationships:

$$B_2 \cdot n = B_1 \cdot n,\ B_2 \times n = (\mu_2/\mu_1) B_1 \times n$$

or $$H_2 \cdot n = (\mu_1/\mu_2) H_1 \cdot n,\ H_2 \times n = H_1 \times n$$

Figure 3:
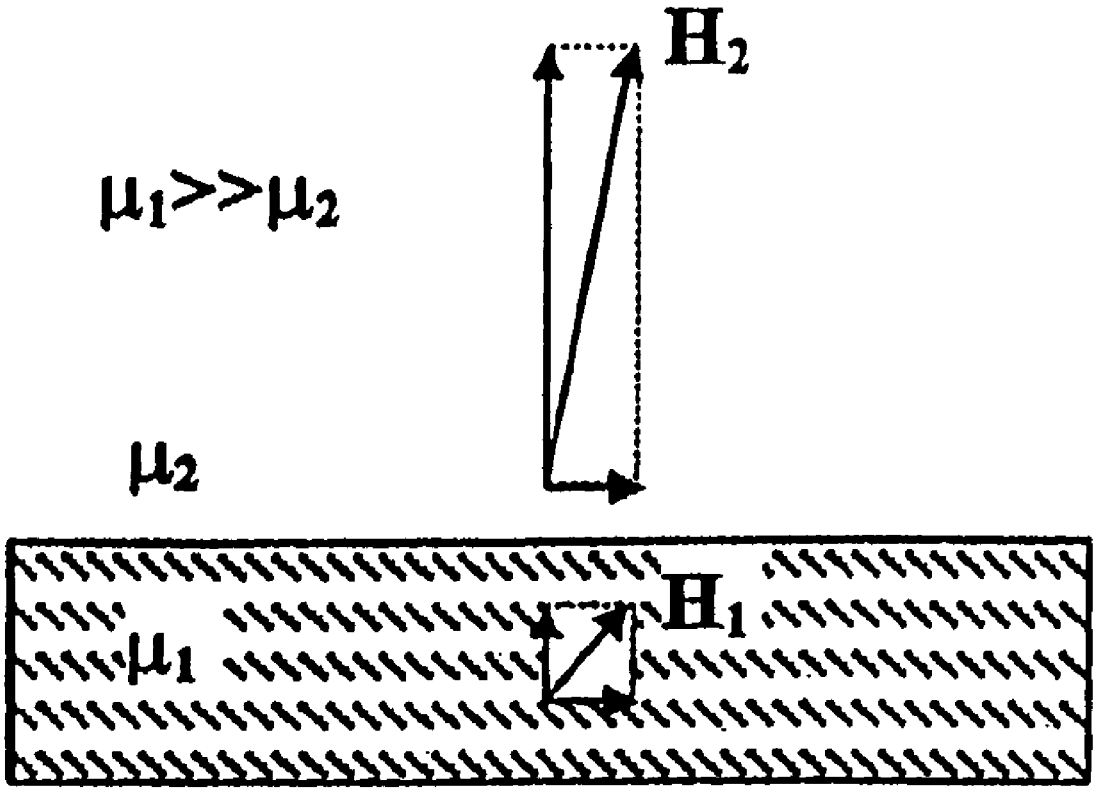
FIG. 3 illustrates the boundary conditions on the magnetic field (H) at a boundary between two materials with different permeability (m1>>m2).

If $\mu_1 >> \mu_2$, the normal component of $H_2$ is much larger than the normal component of $H_1$, as shown in FIG. 3. In the limit $(\mu_1/\mu_2) \rightarrow \infty$, the magnetic field $H_2$ is normal to the boundary surface, independent of the direction of $H_1$ (barring the exceptional case of $H_1$ exactly parallel to the interface). If the second media is air ($\mu_2=1$), then $B_2=\mu_0 H_2$, so that the flux lines $B_2$ will also be perpendicular to the surface. This property is used to produce magnetic fields that are perpendicular to the horizontal plane of the cantilever in a micro-magnetic latching switch and to relax the permanent magnet alignment requirements.

This property, where the magnetic field is normal to the boundary surface of a high-permeability material, and the placement of the cantilever (i.e., soft magnetic) with its horizontal plane parallel to the surface of the high-permeability material, can be used in many different configurations to relax the permanent magnet alignment requirement.

Three-Dimensional Solenoid Coil of the Present Invention

Structural and operational implementations for a three-dimensional solenoid coil according to the present invention are described in detail as follows. These implementations are described herein for illustrative purposes, and are not limiting. The three-dimensional solenoid coil of the present invention, as described in this section, can be achieved using any number of structural implementations, as would be apparent to persons skilled in the relevant art(s) from the teachings herein.

The micro-machined switch of the present invention includes micro-machined cantilevers actuated by a permanent magnet and a solenoid coil. The solenoid coil of the present invention is three-dimensional, residing in more than a single layer. The three-dimensional solenoid coil is positioned in close proximity to the cantilever, relaxes the alignment requirements on the permanent magnet, and improves the overall switching capability of the micro-machined switch. The micro-machined switch is switchable to two stable output states. The three-dimensional solenoid coil of the present invention need not consume power while remaining in one of the output states. Hence, a switch power requirement is reduced by using the three-dimensional solenoid coil of the present invention. In other embodiments, however, power to the coil can be maintained after switching, if so desired.

An example conventional micro-machined switch may include a permanent magnet, a substrate, an embedded coil, and a cantilever at least partially made of soft magnetic materials. The permanent magnet produces a static magnetic field that is preferably perpendicular to the horizontal plane of the cantilever. However, the magnetic field fines produced by a permanent magnet with a typical regular shape (disk, square, etc.) are not necessary perpendicular to the horizontal plane of the cantilever, especially at the edge(s) of the permanent magnet (e.g., disk or square). Any horizontal component of the magnetic field due to the permanent magnet can either eliminate one of the two stable states, or greatly increase the current that is needed to switch the cantilever from one state to the other.

Careful alignment of the permanent magnet relative to the cantilever can aid in beneficially positioning the cantilever relative to the permanent magnet (usually near the center of the permanent magnet) so that two stable states are possible, and that a switching current is reduced. Nevertheless, high-volume production of such a switch can become difficult and costly if the alignment error tolerance is relatively small. Hence, approaches for relaxing the permanent magnet alignment requirement are needed.

As described above, a magnetic dipole can be used to relax the permanent magnet alignment requirements for a micro-mechanical latching switch. In the magnetic dipole approach, a permanent magnet interacts with a thin high-permeability soft magnetic film to create a magnetic field that is approximately perpendicular in a relatively large region around the cantilever, thus relaxing the permanent magnet alignment requirement. This magnetic dipole approach is based on the following property. Magnetic field lines in a low permeability media (e.g., air) are basically perpendicular to the surface of a very high permeability material (e.g., permalloy). When a cantilever is placed in close proximity to such a surface, and a horizontal plane of the cantilever is substantially parallel to the surface of the high permeability material, the resulting switch may operate with two stable states and a relaxed permanent magnet requirement.

Figure 4A:
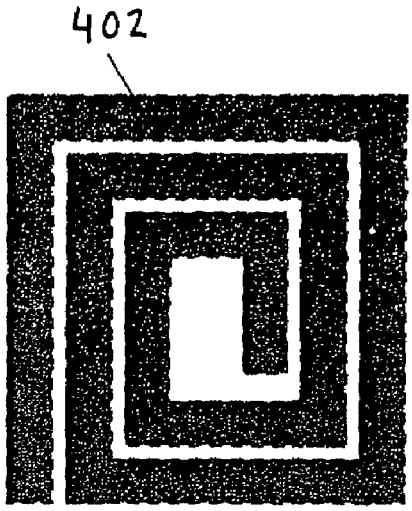
FIGS. 4A-4B illustrates planar coils that may be used in micro-magnetic latching switches.
Figure 4B:
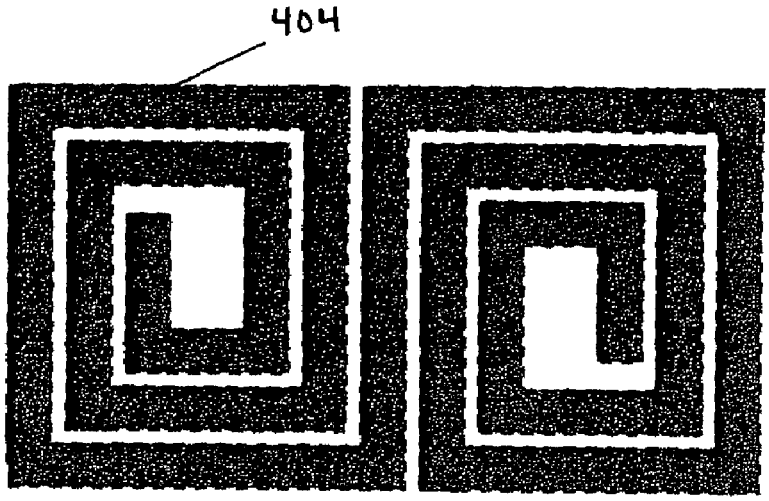

As described above, a conductor such as a coil line can be used to actuate a micro-magnetic latching switch, allowing the switch to transition between stable states. FIGS. 4A-4B illustrates planar coils that may be used in micro-magnetic latching switches for actuation purposes. FIG. 4A shows a planar coil 402. FIG. 4B shows a S-shaped planar coil 404. Planar coil 402 and S-shaped planar coil 404 both have the disadvantage of having relatively large areas. The large areas of planar coil 402 and S-shaped planar coil 404 cause their respective switches to require a large amount of area. Hence, the area required for a coil is a factor in determining the size of a switch. Relatively smaller switch sizes are desirable due to space and cost restrictions.

Figure 5A:
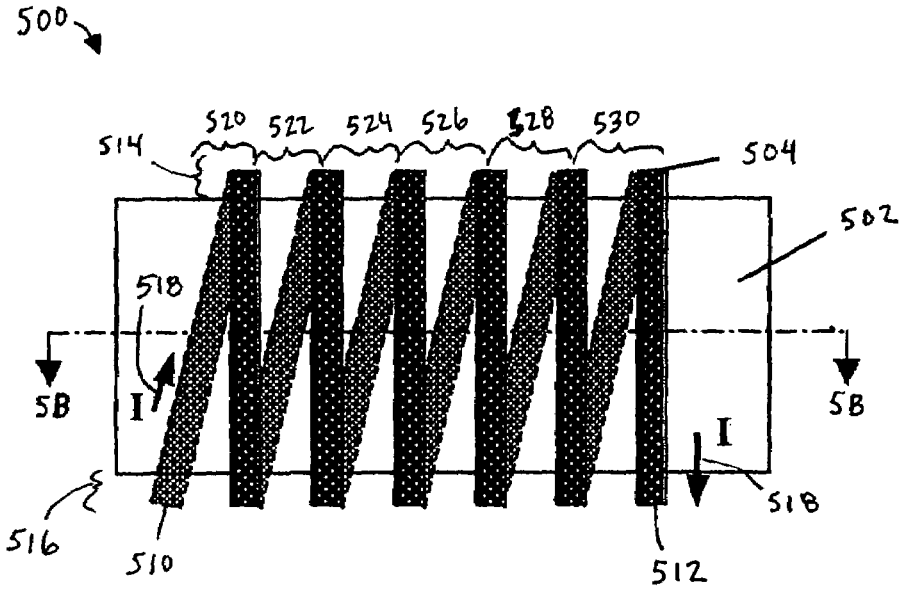
FIGS. 5A-5B illustrate views of a three-dimensional solenoid coil with a magnetic core, according to an embodiment of the present invention.
Figure 5B:
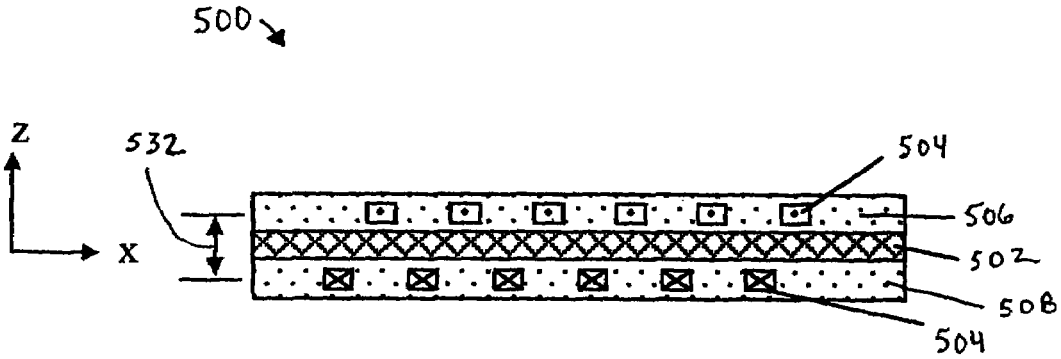

FIGS. 5A-5B illustrate views of a three-dimensional solenoid coil 500, according to an embodiment of the present invention. FIG. 5A shows a plan view of three-dimensional solenoid coil 500, and FIG. 5B shows a cross-sectional view. Three-dimensional solenoid coil 500 can be used instead of planar coil types, for example, to actuate a micro-magnetic latching switch. Three-dimensional solenoid coil 500 uses a smaller area than a planar coil type. Because of this and further features, three-dimensional solenoid coil 500 provides higher flexibility in signal line routing in the design of a micro-magnetic latching switch layout. Furthermore, three-dimensional solenoid coil 500 allows for a relatively large tolerance in permanent magnet alignment.

As shown in FIGS. 5A and 5B, three-dimensional solenoid coil 500 includes a magnetic core 502 and a coil line 504. Three-dimensional solenoid coil 500 further includes a first insulator layer 506 and a second insulator layer 508. A first portion of coil line 504 resides in first insulator layer 506. The second portion of coil line 504 resides in second insulator layer 508. Magnetic core 502 forms a middle layer of three-dimensional solenoid coil 500, located between first insulator layer 506 and second insulator layer 508.

First and second insulator layers 506 and 508 are portions of an insulator material that houses and insulates the respective portions of coil line 504 from magnetic core 502. First and second insulator layers 506 and 508 are made of an electrically insulating material. For example, first and second insulating layers 506 and 508 are formed of a material such as oxide or another insulator such as a thin-film insulator. In an exemplary embodiment, they are formed of Probimide 7510 material. First and second edges 514 and 516 of coil line 504, which extend around magnetic core 502 between first and second insulator layers 506 and 508, are also encapsulated by the insulator material.

Coil line 504 encircles or is wrapped at least once around magnetic core 502. As shown in the example embodiment of FIG. 5A, coil line 504 is wrapped six times around magnetic core 502, including a first turn 520, a second turn 522, a third turn 524, a fourth turn 526, a fifth turn 528, and a sixth turn 530. Similarly to conductor 114 described above with respect to FIGS. 1A and 1B, coil line 504 is formed of any material capable of conducting electricity such as gold, silver, copper, aluminum, metal or the like. Coil line 504 may be formed to encircle magnetic core 502 using a variety of processes, including being formed progressively in layers, and being formed as a single line that is physically wrapped around magnetic core 502.

As coil line 504 conducts an electric current, a magnetic field is generated around coil line 504. Coil line 504 has first and second ends 510 and 512 for applying a current to three-dimensional solenoid coil 500 to cause it to produce the magnetic field. FIG. 5A shows a first direction 518 for current flowing through coil line 504. As shown in FIG. 5B for first direction 518, current flowing through the first portion of coil line 504 in first insulator layer 506 is flowing in a "toward" direction (i.e., into the page), while current flowing through the second portion of coil line 504 in second insulator layer 508 is flowing in an "away" direction (i.e., out of the page). (In FIG. 5B, the "toward" direction is indicated by the "dot" symbols, and the "away" direction is indicated by the "x" symbols in coil line 504). Current is applied to first and second ends 510 and 512 to flow in first direction 518 to have the respective switch transition to a first state. To have the switch transition to a second state, current can be applied to first and second ends 510 and 512 to flow in a direction opposite to first direction 518. Note that a current need only be applied temporarily, to cause the switch to transition from a current operating state to a different operating state. Current does not need to be applied to three-dimensional solenoid coil 500 after causing the state of switch 800 to switch, which reduces a power requirement for switch 800 over conventional switches. Constant application of the switching current is not precluded by the present invention, however.

Magnetic core 502 is made of a high permeability soft magnetic material, such as a permalloy, etc. When current flows through coil line 504, a magnetic field is generated around coil line 504. When magnetic core 502 is not present in three-dimensional solenoid coil 500, the magnetic field generated by coil line 504 is relatively weak. This is because the magnetic field generated by the first portion of coil line 504 in first insulator layer 506 tends to cancel the magnetic field generated by the second portion of coil line 504 in second insulator layer 508. When present, magnetic core 502 strengthens the magnetic field due to coil line 504, and to shield the magnetic field interference (or cancellation) from the lower part of coil line 504, which improves switching performance. Furthermore, magnetic core 502 modulates the magnetic field due to a permanent magnet near the surface of magnetic core 502 to line up in the z-axis direction (the z-axis is shown in FIG. 5B), even when magnetic core 502 is relatively thin (for example, 2 μm thick). Hence, the permanent magnet alignment tolerance is relaxed by the presence of magnetic core 502.

FIG. 5B shows a distance 532 between the first portion of coil line 504 in first insulator layer 506 and the second portion of coil line 504 in second insulator layer 508. If distance 532 is relatively small, it is difficult for coil line 504 to generate a strong enough magnetic field to cause the related switch to change states. By positioning magnetic core 502 within coil line 502 as shown in FIG. 5A and 5B, the magnetic fields generated by the first and second portions of coil line 504 do not cancel each other as effectively, because magnetic core 502 substantially shields them from each other. In other words, a magnetic field generated by the first portion of coil line 504 in first insulator 506 does not effectively penetrate magnetic core 502 to cancel the magnetic field due to the second portion of coil line 504 in second insulator 508 on the opposite side of magnetic core 502, and vice versa. Instead, the magnetic field generated by the first portion of coil line 504 in first insulator 506 is reflected by magnetic core 502. Because of this reflection, the horizontal magnetic field component due to coil line 504 in the area of a cantilever will be strengthened. For example, the horizontal magnetic field component can be doubled when the reflection is 100% efficient. If the reflection is less than 100% efficient, the increase in the horizontal magnetic field component is a corresponding amount less than double. Furthermore, due to this benefit, three-dimensional solenoid coil 500 can be configured to have a relatively smaller distance 532, with first and second insulator layers 506 and 508 thinner and/or closer together.

Figure 6A:
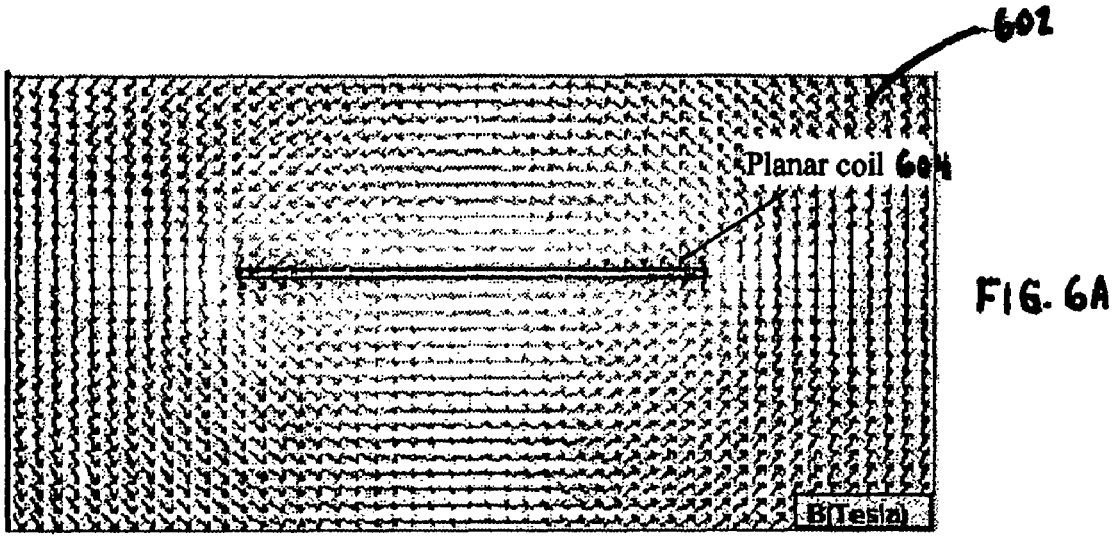
FIGS. 6A-6B shows simulations of magnetic fields related to planar coils.
Figure 6B:
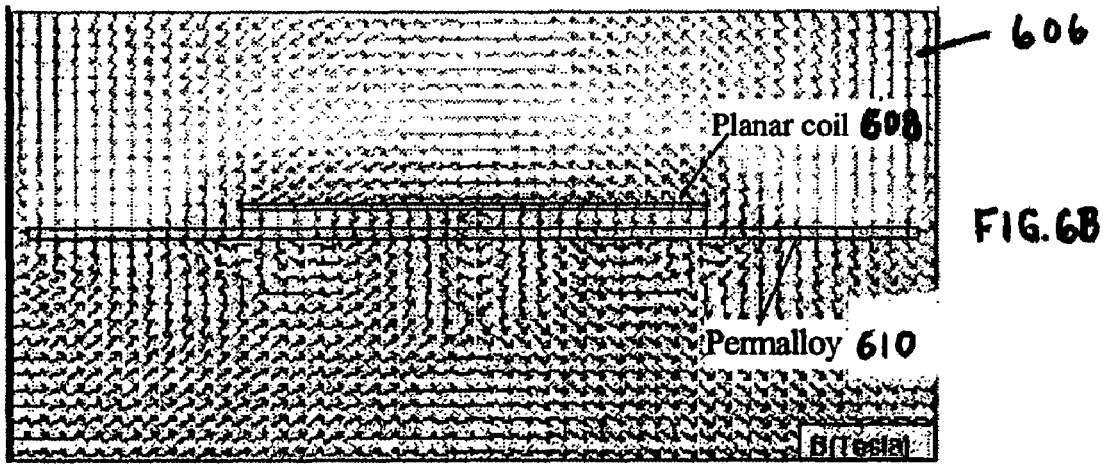
Figure 6C:
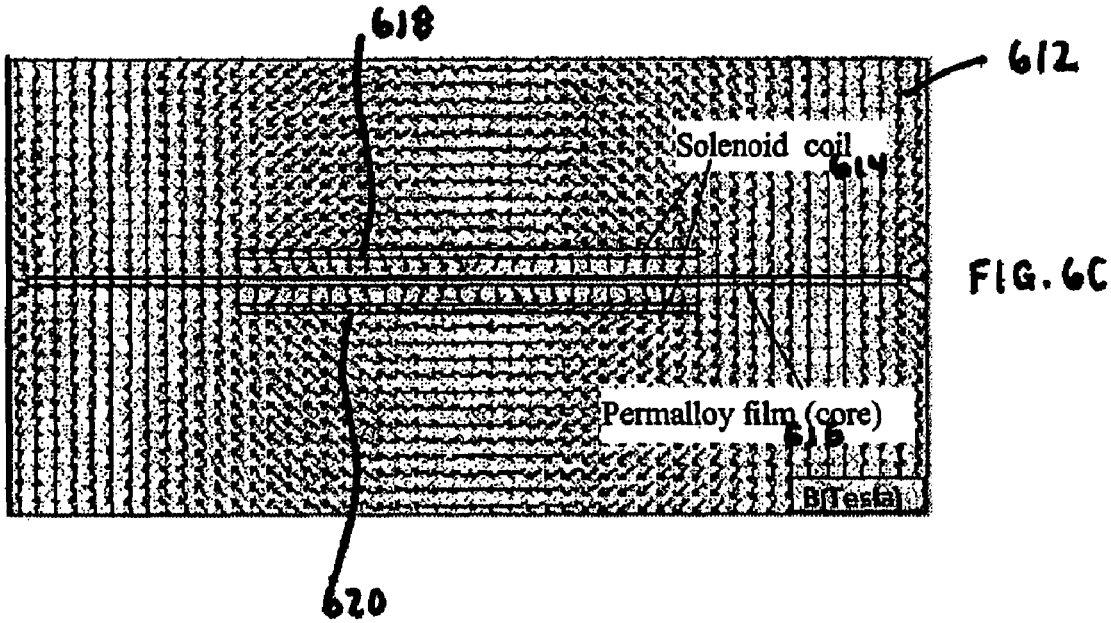
FIG. 6C shows a simulation of a magnetic field for a three-dimensional solenoid coil with a permalloy core, according to an embodiment of the present invention.

FIGS. 6A and 6B show magnetic field simulations of three-dimensional coils compared to planar coils. FIG. 6A shows a simulation of a magnetic field 602 due to a five-turn planar coil 604 with a 100 mA current flowing therein in a "toward" direction. Five-turn planar coil 604 is represented as a 100 μm wide by 2 μm thick rectangle. FIG. 6B shows a simulation of a magnetic field 606 due to a five-turn planar coil 608 with a 100 mA current flowing in a "toward" direction. Five-turn planar coil 608 is positioned 4 μm above a 192 μm wide by 2 μm thick permalloy film 610. Five-turn planar coil 608 is represented as a 100 μm wide by 2 μm thick rectangle in FIG. 6B. FIG. 6C shows a simulation of a magnetic field 612 for a five-turn three-dimensional solenoid coil line 614 with a magnetic core 616, according to an embodiment of the present invention. Three-dimensional solenoid coil line 614 has a 100 mA current flowing in a "toward" direction in a first portion 618, and in an "away" direction in a second portion 620. First and second portions 618 and 620 are both represented as a 100 μm wide by 2 μm thick rectangles. Magnetic core 616 is a 192 μm wide by 2 μm thick permalloy film 610.

Figure 7:
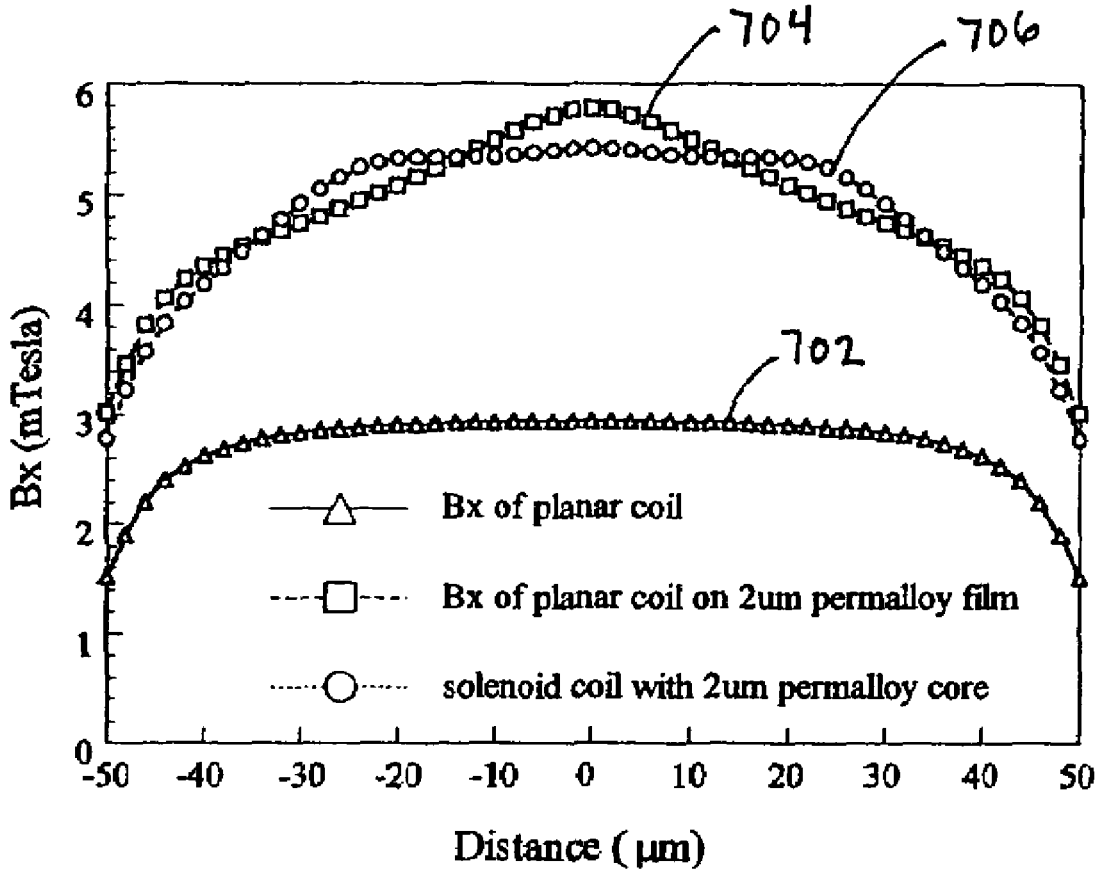
FIG. 7 shows horizontal field component profiles corresponding to the coil magnetic field simulations shown in FIGS. 6A-6C.

FIG. 7 shows horizontal field component profiles corresponding to the coil magnetic field simulations shown in FIGS. 6A-6C. FIG. 7 shows a first profile 702 for planar coil 604, a second profile 704 for planar coil 608 with permalloy film 610, and a third profile 706 for three-dimensional solenoid coil line 614 with magnetic core 616. In FIG. 7, the magnetic field strength is plotted against the distance from the center of planar coil 604, planar coil 608, and first portion 618 of three-dimensional solenoid coil line 614, for first, second, and third profiles 702, 704, and 706, respectively. As shown in FIG. 7, third profile 706 has a greater magnetic field strength than first profile 702 for all distances. FIG. 7 also shows that third profile 706 has a magnetic field strength greater than or roughly equal to that of second profile 704 for the majority of the distance span. Hence, as indicated by FIG. 7, a solenoid coil may be effectively used to generate a magnetic field to actuate a micro-magnetic switch, as compared to planar coils.

Micro-Magnetic Latching Switch with Three-Dimensional Solenoid Coil Embodiments of the Present Invention Structural and operational implementations for switches having a three-dimensional solenoid coil according to the present invention are described in detail as follows. These implementations are described herein for illustrative purposes, and are not limiting. These switches, as described in this section, can be achieved using any number of structural implementations, as would be apparent to persons skilled in the relevant art(s) from the teachings herein.

Figure 8A:
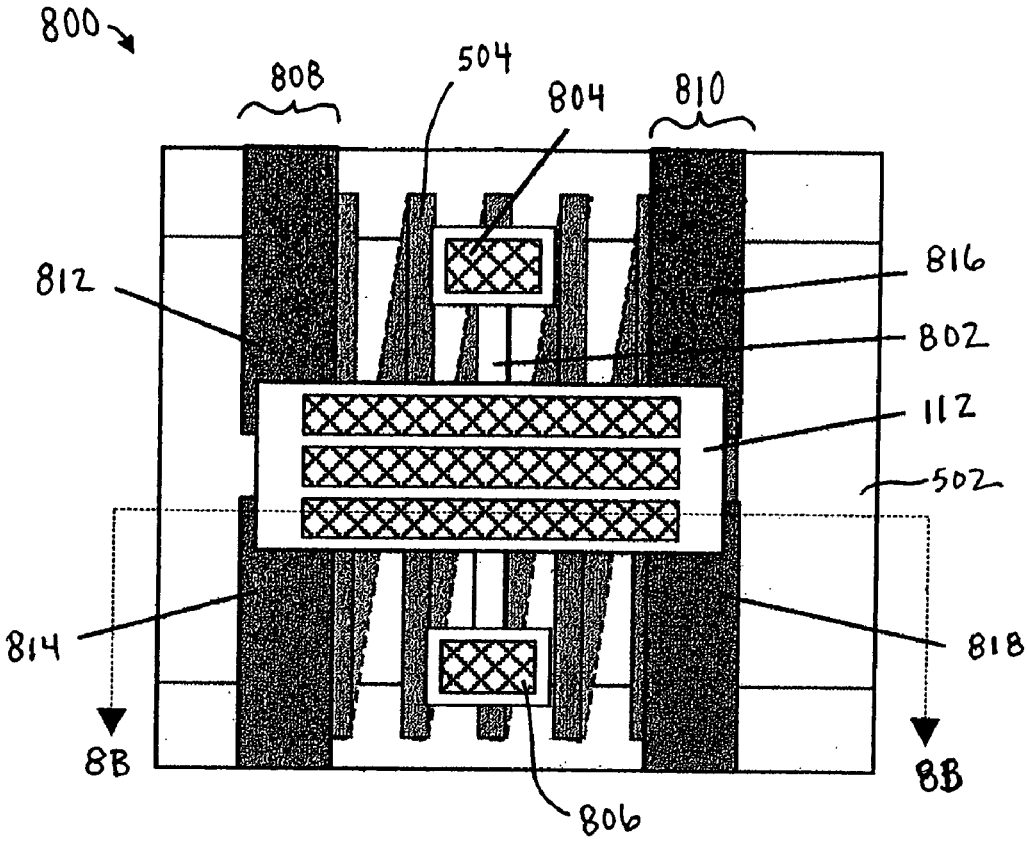
FIGS. 8A-8B illustrate views of a micro-magnetic latching switch with three-dimensional solenoid coil, according to an embodiment of the present invention.
Figure 8B:
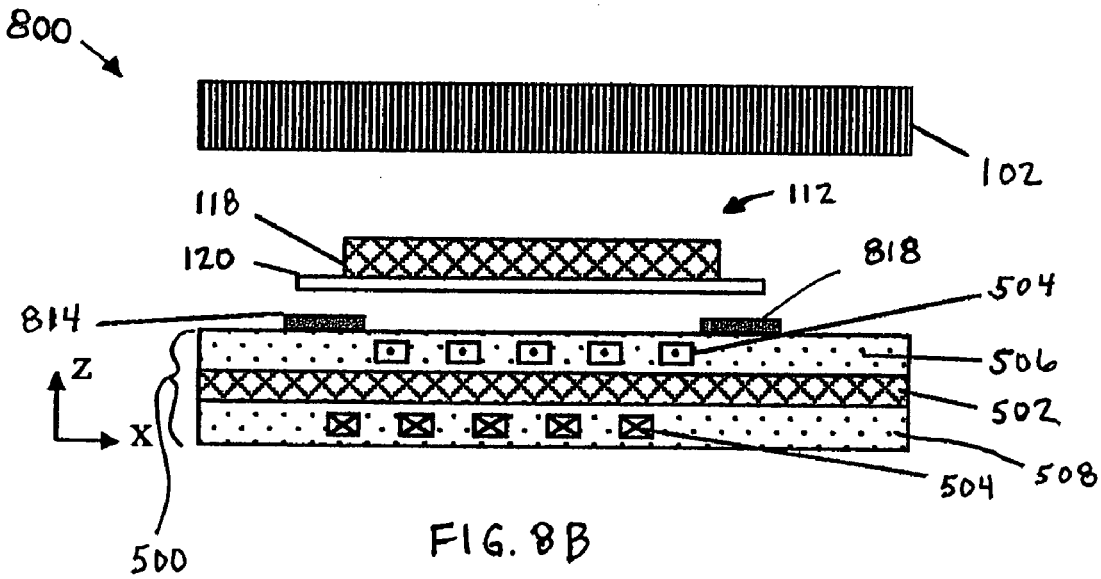

FIGS. 8A-8B illustrate views of a micro-magnetic latching switch 800 with three-dimensional solenoid coil 500, according to an embodiment of the present invention. FIG. 8A illustrates a plan view of micro-magnetic latching switch 800. FIG. 8B illustrates a cross-sectional view of micro-magnetic latching switch 800.

As shown in FIGS. 8A and 8B, switch 800 includes magnet 102, cantilever 112, a cantilever hinge (also called a flexure) 802, a first support stage 804, a second support stage 806, a first signal transmission line 808, a second signal transmission line 810, and three-dimensional solenoid coil 500.

First signal transmission line 808 includes a first input signal line 812 and a first output signal line 814. Second signal transmission line 810 includes a second input signal line 816 and a second output signal line 818. In a first stable state for switch 800, first input signal line 812 is coupled to first output signal line 814, as described below, allowing a signal to be transmitted through first signal transmission line 808. In a second stable state for switch 800, second input signal line 816 is coupled to second output signal line 818, also as described below, allowing a signal to be transmitted through second signal transmission line 810. In an alternative embodiment, switch 800 can include only one of first and second transmission lines 808 and 810.

As shown in FIGS. 8A and 8B, cantilever 112 includes bottom conducting layer 120 and magnetic layer 118. The invention is also applicable to fewer or additional soft magnetic layers. Magnetic layer 118 is shown in FIG. 8A as having three sections for illustrative purposes, and in alternative embodiments may have any number of one or more sections. Magnetic layer 118 is manufactured from soft magnetic materials, as are described above. In embodiments, to reduce parasitic effects, cantilever 112 may include an insulator layer (not shown in FIGS. 8A and 8B) that separates conducting layer 120 from magnetic layer 118.

As shown in FIG. 8A, cantilever 112 is supported by cantilever hinge 802. Cantilever hinge 802 is supported on two ends by first and second support stages 804 and 806. Cantilever hinge 802 rotationally flexes between first and second support stages 804 and 806 to allow cantilever 112 to rotate according to the magnetic actuation mechanism described herein. Note that alternative structures for supporting and allowing rotation of cantilever 112 are also applicable to the present invention, as would be known by persons skilled in the relevant art(s), such as staging layer 110 described above.

Magnet 102 is a permanent magnet that is magnetized in the z-axis direction, shown in FIG. 8B. Magnet 102 provides a substantially uniform and constant magnetic field, as is described above with regard to FIG. 1, and as further described above in the discussion regarding relaxed alignment of magnets. In FIG. 8B, cantilever 112 is shown located in the magnetic field below magnet 102. However, magnet 102 can be instead oriented below cantilever 112. Furthermore, note that a second magnet can be used with magnet 102 to provide an even more uniform magnetic field in a region between them, where cantilever 112 may be located.

During operation, cantilever 112 resides in one of two stable states, which are not shown in FIGS. 8A and 8B. To actuate or move cantilever 112 into the first stable state, a first current pulse is applied in a first direction through coil 504. The first current pulse produces a temporary magnetic field that can realign the magnetization in magnetic layer 118 of cantilever 112. A torque is exerted on cantilever 112 by the temporary magnetic field, causing cantilever 112 to rotate in a direction in an attempt to align with the temporary magnetic field, as described above. Hence, cantilever 112 switches to the first stable state. For example, for movement into the first stable state, cantilever 112 may rotate to the left, around the axis of cantilever hinge 802. In this position for cantilever 112, conducting layer 120 on the bottom surface of cantilever 112 short circuits (i.e., electrically connects) first input signal line 812 with first output signal line 814. Hence, first signal transmission line 808 can conduct a signal in the first stable state, while second signal transmission line 810 cannot conduct a signal. Accordingly, first signal transmission line 808 is in an "ON" state, while second signal transmission line 810 is in an "OFF" state. After the first current pulse in the first direction through coil 504 is complete, cantilever 112 remains in the first stable state.

To actuate or move cantilever 112 into the second stable state, a second current pulse is applied in a second direction through coil 504. The second direction is opposite to the first direction. In other words, the second current pulse is of an opposite polarity to that of the first current pulse. The second current pulse produces a temporary magnetic field that can realign the magnetization in magnetic layer 118 of cantilever 112. A torque is exerted on cantilever 112 by the temporary magnetic field, causing cantilever 112 to rotate in a direction in an attempt to align with the temporary magnetic field, which is a direction opposite to that of the first stable state. Hence, cantilever 112 switches to the second stable state. For example, for movement into the second stable state, cantilever 112 may rotate to the right, around the axis of cantilever hinge 802. In this position for cantilever 112, conducting layer 120 on the bottom surface of cantilever 112 shorts second input signal line 816 with second output signal line 818. Hence, second signal transmission line 810 can conduct a signal in the second stable state. However, first signal transmission line 808 cannot conduct a signal, because first input signal line 812 is decoupled from first output signal line 814. Accordingly, first signal transmission line 808 is in an "OFF" state, while second signal transmission line 810 is in an "ON" state. After the second current pulse in the second direction through coil 504 is complete, cantilever 112 remains in the second stable state.

In the embodiment shown in FIGS. 8A and 8B, switch 800 is shown as a latching single-pole double-throw switch. Note that in alternative embodiments, for example, single-pole single-throw, and other configurations for a magnetically actuated switch 800 are also possible, as would be understood by persons skilled in the relevant art(s) from the teachings herein.

Figure 9:
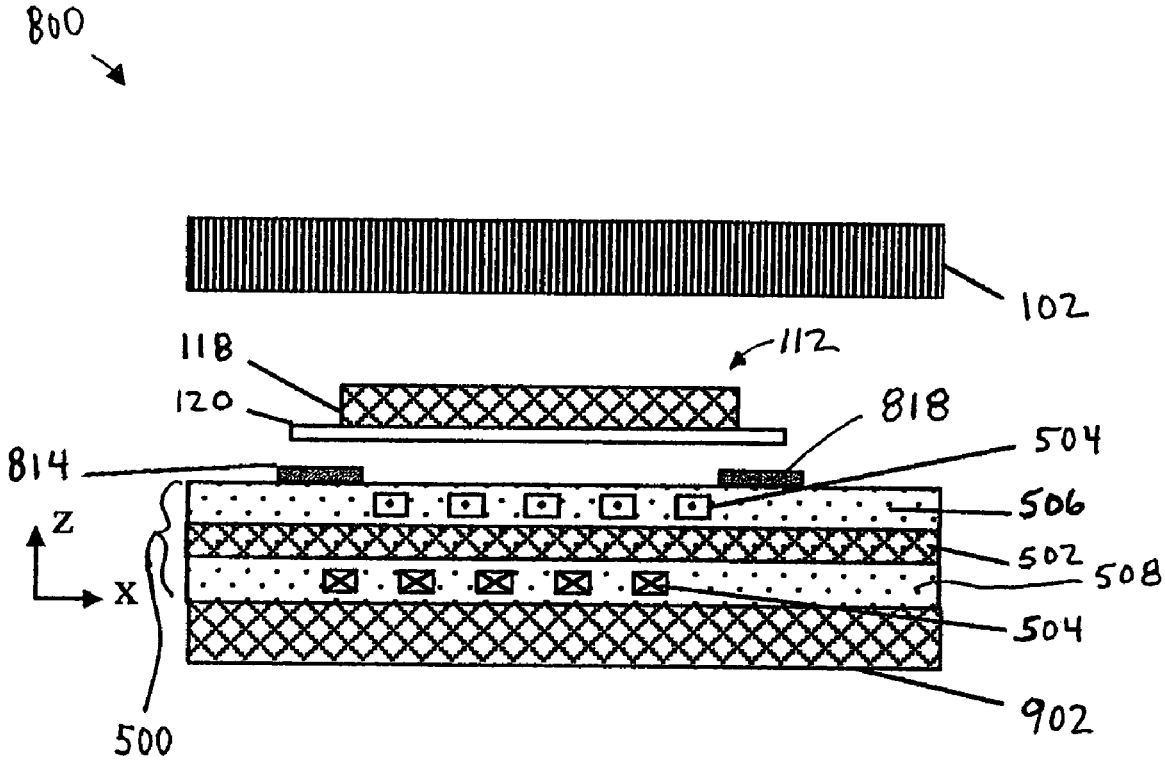
FIG. 9 illustrates a cross-sectional view of a micro-magnetic switch with three-dimensional solenoid coil, having an additional permalloy layer, according to an embodiment of the present invention.

FIG. 9 illustrates a cross-sectional view of micro-magnetic latching switch 800, with three-dimensional solenoid coil 500, according to a further embodiment of the present invention. As shown in FIG. 9, micro-magnetic latching switch 800 includes a magnetic layer 902. Magnetic layer 902 is a soft magnetic material such as a permalloy, etc. Magnetic layer 902 improves the alignment with the z-axis of the magnetic field produced by three-dimensional solenoid coil 500, and hence improves actuation of cantilever 112 by three-dimensional solenoid coil 500.

In a RF signal switching application for micro-magnetic latching switch 800, magnetic layer 902 can serve as a ground plane. In combination with first and/or second signal transmission lines 808 and 810, magnetic layer 902 can act as a strip transmission line. In a RF signal switching embodiment, for improved RF signal performance, a surface of magnetic layer 902 can be coated with a non-magnetic metal film, such as gold, silver, copper, aluminum, other metal, or metal alloy. For example, the surface of magnetic layer 902 shown in FIG. 9 to be in contact with insulator layer 508 can be coated with the non-magnetic metal film.

Figure 10:
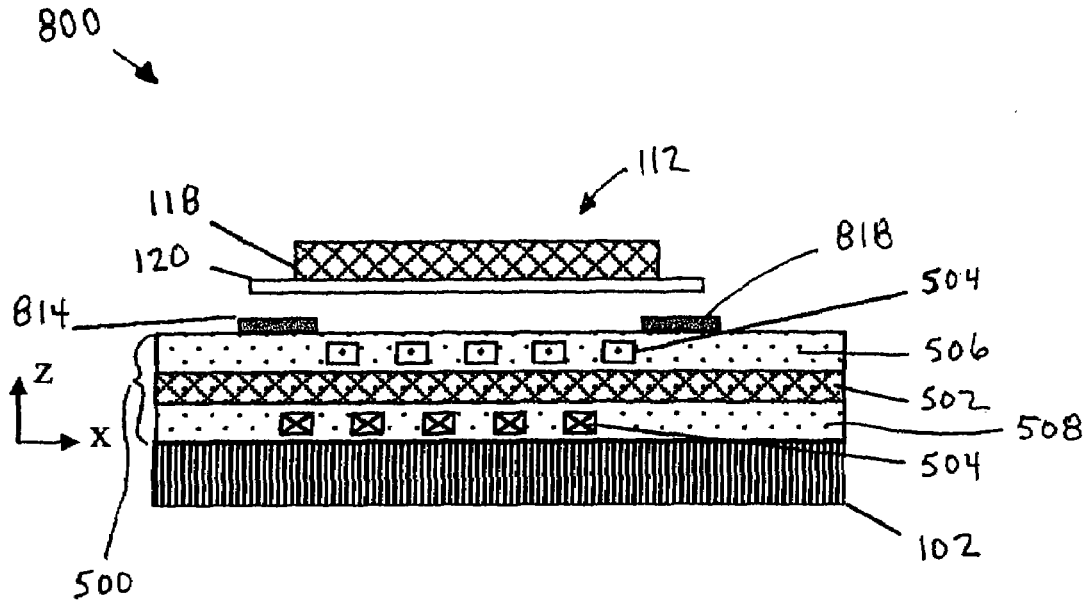
FIGS. 10 and 11 show cross-sectional views of micro-magnetic switches with three-dimensional solenoid coil, according to further embodiments of the present invention.
Figure 11:
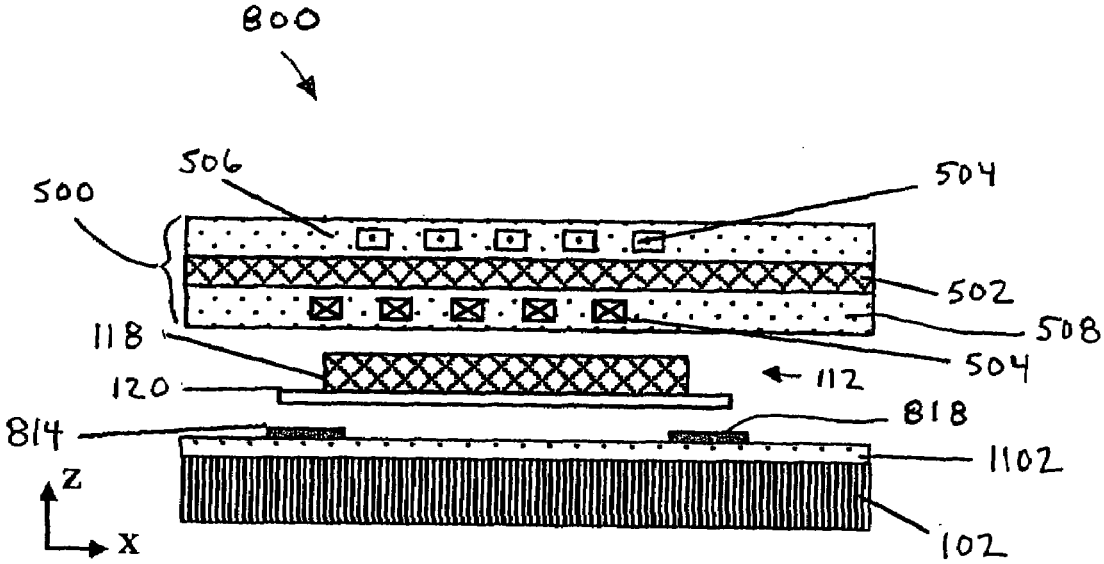

Many configurations and orientations are applicable to micro-magnetic latching switch 800, as would be known to persons skilled in the relevant art(s) from the teachings herein. For example, FIGS. 10 and 11 show cross-sectional views of micro-magnetic latching switch 800 with three-dimensional solenoid coil 500, according to further embodiments of the present invention. As shown in FIG. 10, magnet 102 can be placed under three-dimensional solenoid coil 500, such that three-dimensional solenoid coil 500 is positioned between cantilever 112 and magnet 102. First insulator layer 506 operates as a top substrate layer in the embodiment of FIG. 10, as it does in the embodiments shown in FIGS. 8A, 8B, and 9.

As shown in FIG. 11, three-dimensional solenoid coil 500 can be fabricated separately, and mounted above cantilever 112. In FIG. 11, an insulator or substrate layer 1102 is formed on magnet 102, to support cantilever 112 and first and second signal transmission lines 808 and 810. In an alternative embodiment, cantilever 112 may be supported directly on magnet 102.

Other cantilever, magnet, and permalloy layer configurations are possible, as described in pending application Ser. No. 10/051,447, filed Jan. 18, 2002 (now U.S. Pat. No. 6,794,965 , which is incorporated herein by reference.

Figure 12A:
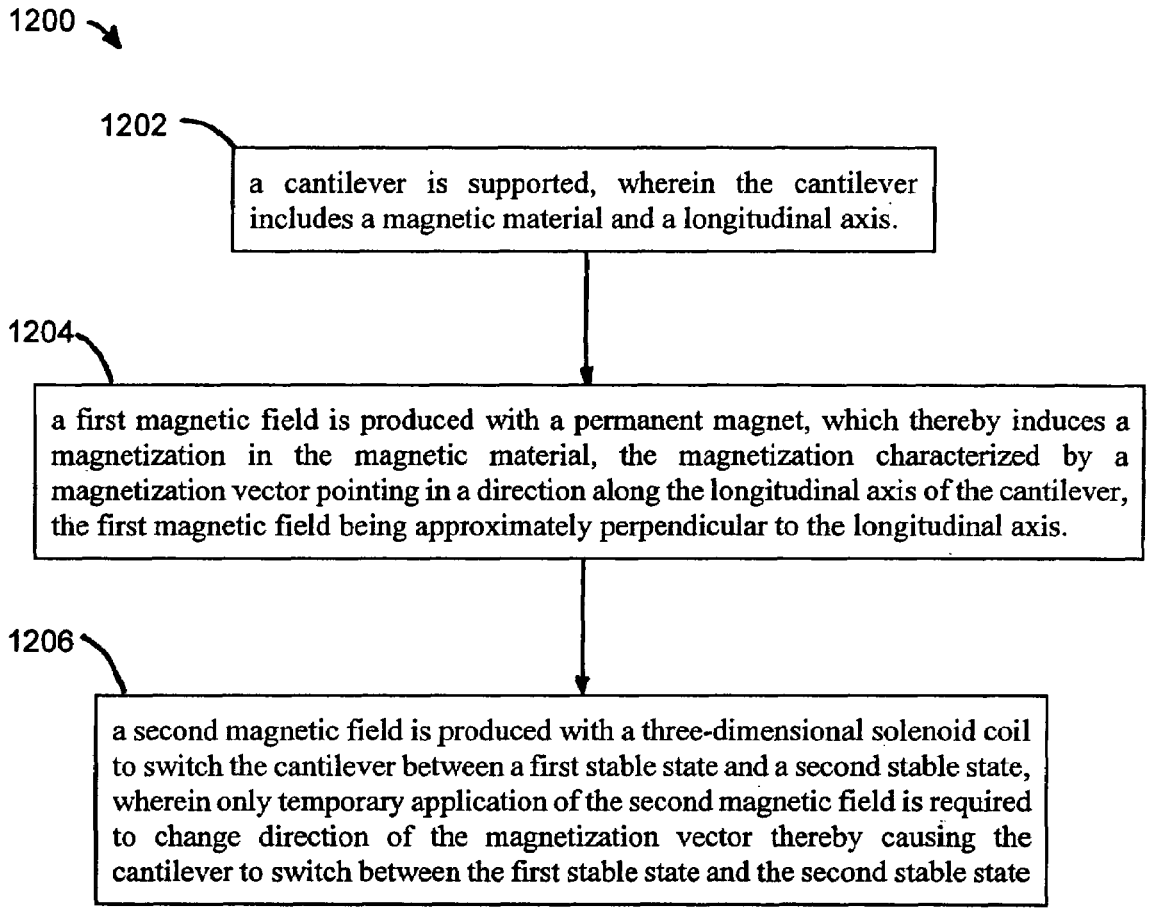
FIGS. 12A-12M shows flowcharts providing steps for operating micro-machined RF switch embodiments of the present invention.

FIG. 12A shows a flowchart 1200 providing steps for operating micro-machined RF switch embodiments of the present invention. FIGS. 12B-12M show additional steps, according to further embodiments of the present invention. The steps of FIGS. 12A-12M do not necessarily have to occur in the order shown, as will be apparent to persons skilled in the relevant art(s) based on the teachings herein. Other structural embodiments will be apparent to persons skilled in the relevant art(s) based on the following discussion. These steps are described in detail below.

Flowchart 1200 begins in FIG. 12A with step 1202. In step 1202, a cantilever is supported, wherein the cantilever includes a magnetic material and a longitudinal axis. For example, the cantilever is cantilever 112 of switch 800, shown in FIGS. 8A and 8B. The magnetic material can be magnetic material 118, for example. The longitudinal axis is an axis of cantilever 112 in line with the long axis L shown for cantilever 112 in FIG. 2. Cantilever 112 is shown in FIGS. 8A and 8B supported on substrate 104, and can also be supported by substrate 1102 as shown in FIG. 11, by magnet 102 (not shown), and by further components/surfaces of switch 800.

In step 1204, a first magnetic field is produced with a permanent magnet, which thereby induces a magnetization in the magnetic material, the magnetization characterized by a magnetization vector pointing in a direction along the longitudinal axis of the cantilever, the first magnetic field being approximately perpendicular to the longitudinal axis. For example, the first magnetic field is $H_0$ 134, as shown in FIGS. 1A and 1B. The magnetic field can be produced by magnet 102, which can be a permanent magnet. In an alternative embodiment, the magnetic field is produced by more than one permanent magnet, such as a first permanent magnet above and a second permanent magnet below cantilever 112. A magnetization induced in the magnetic material can be characterized as a magnetization vector, such as magnetization vector "m" as shown in FIG. 2. As shown in FIG. 1, first magnetic field $H_0$ 134 is approximately perpendicular to long axis L shown for cantilever 112 in FIG. 2.

In step 1206, a second magnetic field is produced with a three-dimensional solenoid coil to switch the cantilever between a first stable state and a second stable state, wherein only temporary application of the second magnetic field is required to change direction of the magnetization vector thereby causing the cantilever to switch between the first stable state and the second stable state. For example, the second magnetic field is produced by three-dimensional solenoid coil 500 shown in FIGS. 5A and 5B. The second magnetic field switches cantilever 112 between two stable states, such as the first and second stable states described above. As described above, only a temporary application of the second magnetic field produced by coil 114 is required to change direction of magnetization vector "m" shown in FIG. 2. Changing the direction of magnetization vector "m" causes cantilever 112 to switch between the first stable state and the second stable state. In embodiments of the present invention, three-dimensional solenoid coil 500 produces the temporarily applied second magnetic filed to change direction of the magnetization vector "m" of cantilever 112.

In an embodiment, the three-dimensional solenoid coil of step 1206 includes a magnetic core and a coil line. For example, the magnetic core is magnetic core 502 and the coil line is coil line 504 shown in FIGS. 5A-5B.

Figure 12B:
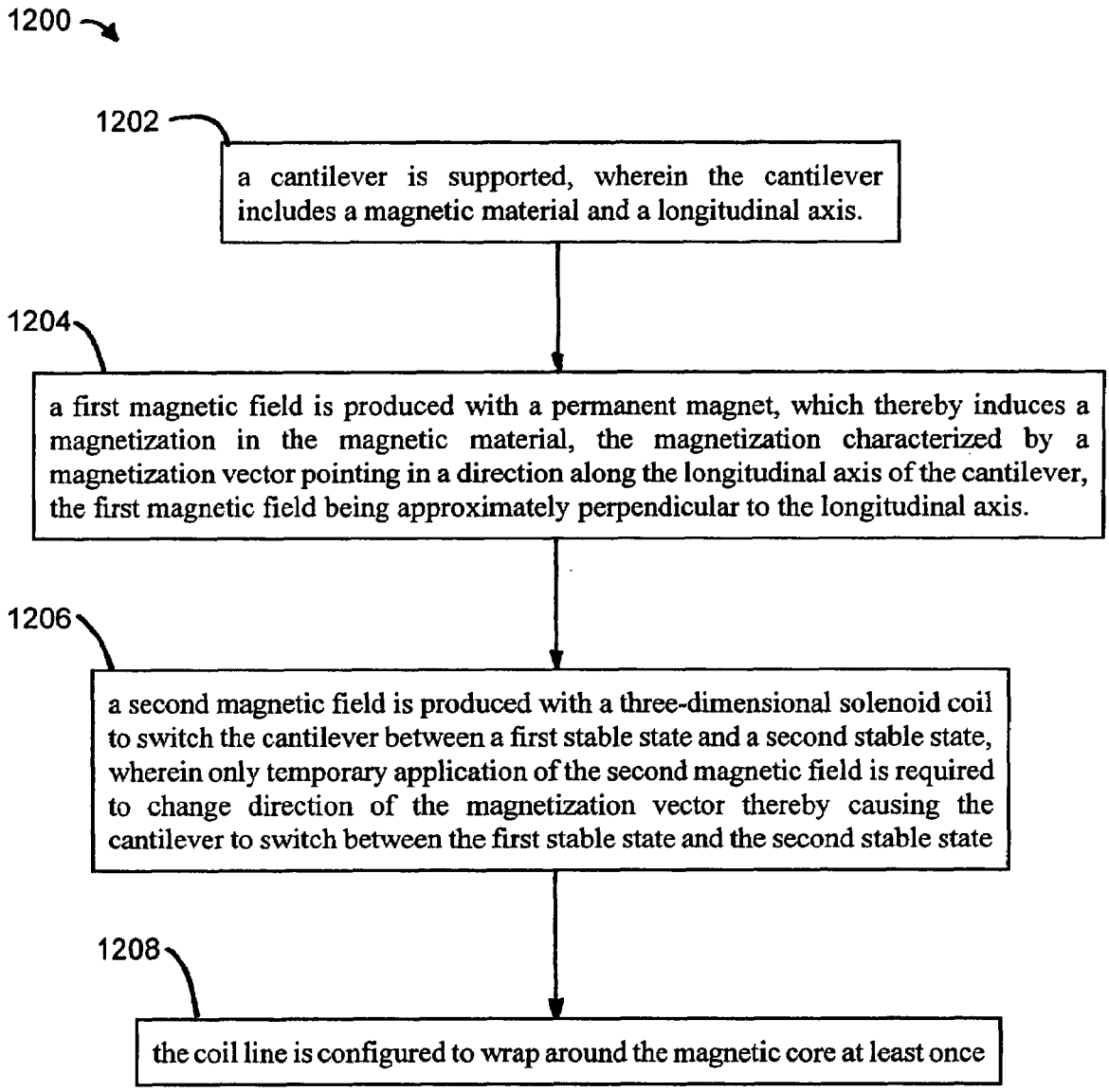

FIG. 12B shows flowchart 1200 with an additional step 1208. In step 1208, the coil line is configured to wrap around the magnetic core at least once. For example, as shown in FIG. 5A, coil line 504 is wrapped around magnetic core 502 six times. Coil line 504 may be wrapped around magnetic core 502 as many times as needed to produce the second magnetic field with characteristics as required by the particular application.

Figure 12C:
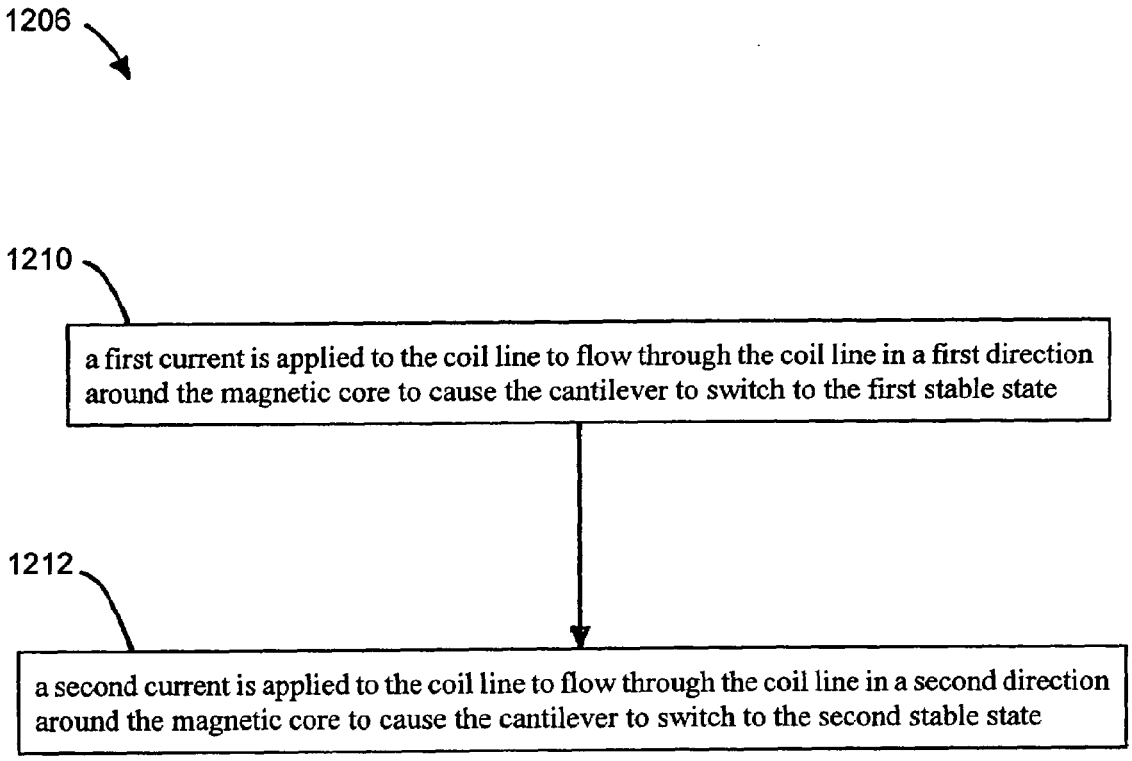
Figure 12D:
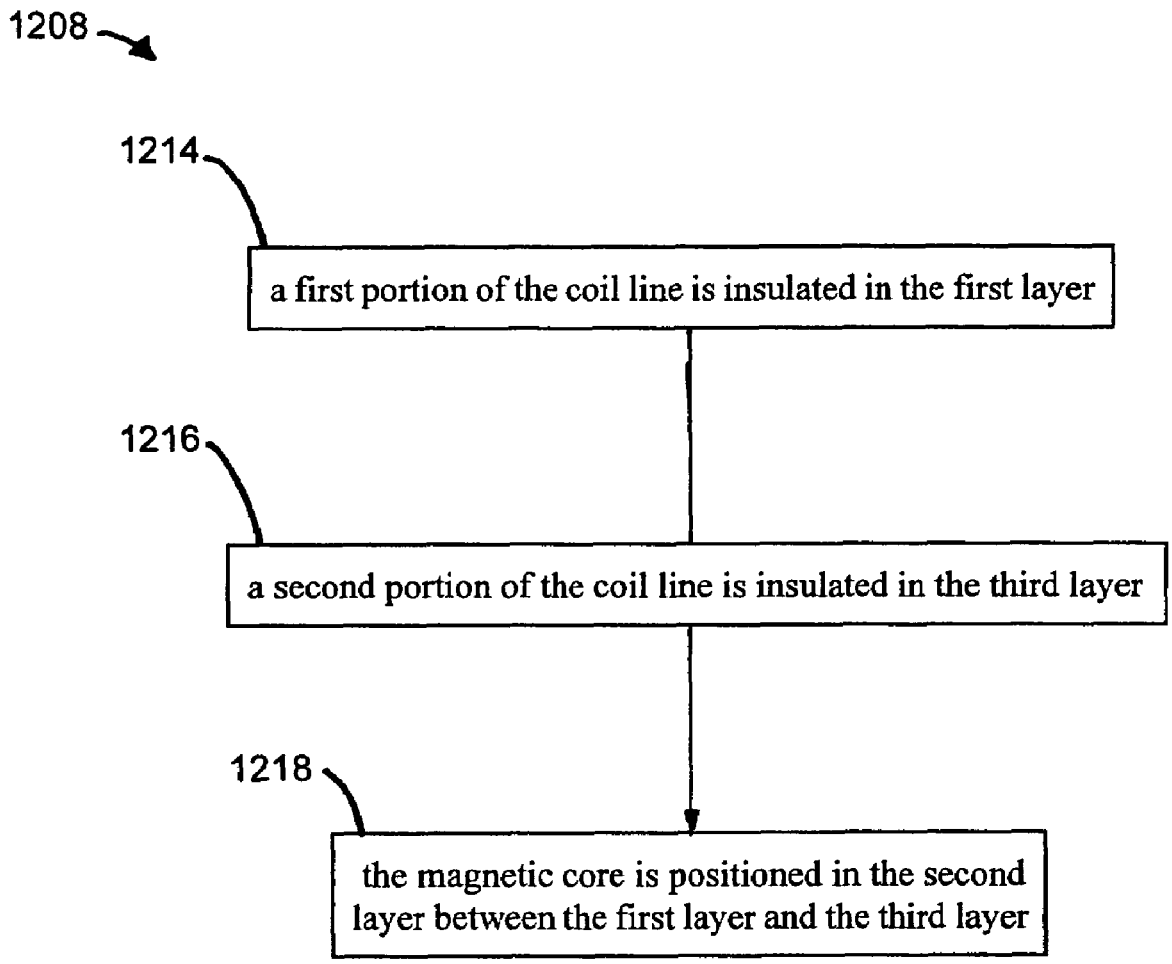

For example, in an embodiment, step 1206 of FIG. 12B includes the steps shown in FIG. 12C. In step 1210, a first current is applied to the coil line to flow through the coil line in a first direction around the magnetic core to cause the cantilever to switch to the first stable state. For example the first current is applied to coil line 504 across ends 510 and 512 to flow in direction 518 shown in FIG. 5A, causing cantilever 112 to switch to the first stable state.

In step 1212, a second current is applied to the coil line to flow through the coil line in a second direction around the magnetic core to cause the cantilever to switch to the second stable state. For example the second current is applied to coil line 504 across ends 510 and 512 to flow in a direction opposite to direction 518, causing cantilever 112 to switch to the second stable state.

In an embodiment, the three-dimensional solenoid coil includes a first layer, a second layer, and a third layer. For example, the first, second, and third layers of three-dimensional solenoid coil 500 are first insulator layer 506, magnetic core 502, and second magnetic layer 508 as shown in FIG. 5. In an embodiment, these layers may be configured as described by the flowchart of FIG. 12D. For example, step 1208 of FIG. 12B can include the steps shown in FIG. 12D. In step 1214, a first portion of the coil line is insulated in the first layer. For example, as shown in FIG. 5B, a first portion of coil line 504 is insulated in first insulator layer 506, which is the first layer.

In step 1216, a second portion of the coil line is insulated in the third layer. For example, as shown in FIG. 5B, a second portion of coil line 504 is insulated in second insulator layer 508, which is the third layer.

In step 1218, the magnetic core is positioned in the second layer between the first layer and the third layer. For example, as shown in FIG. 5B, magnetic core is the second layer, and is positioned between first insulator layer 506 and second insulator layer 508, which are the first and third layers.

Figure 12E:
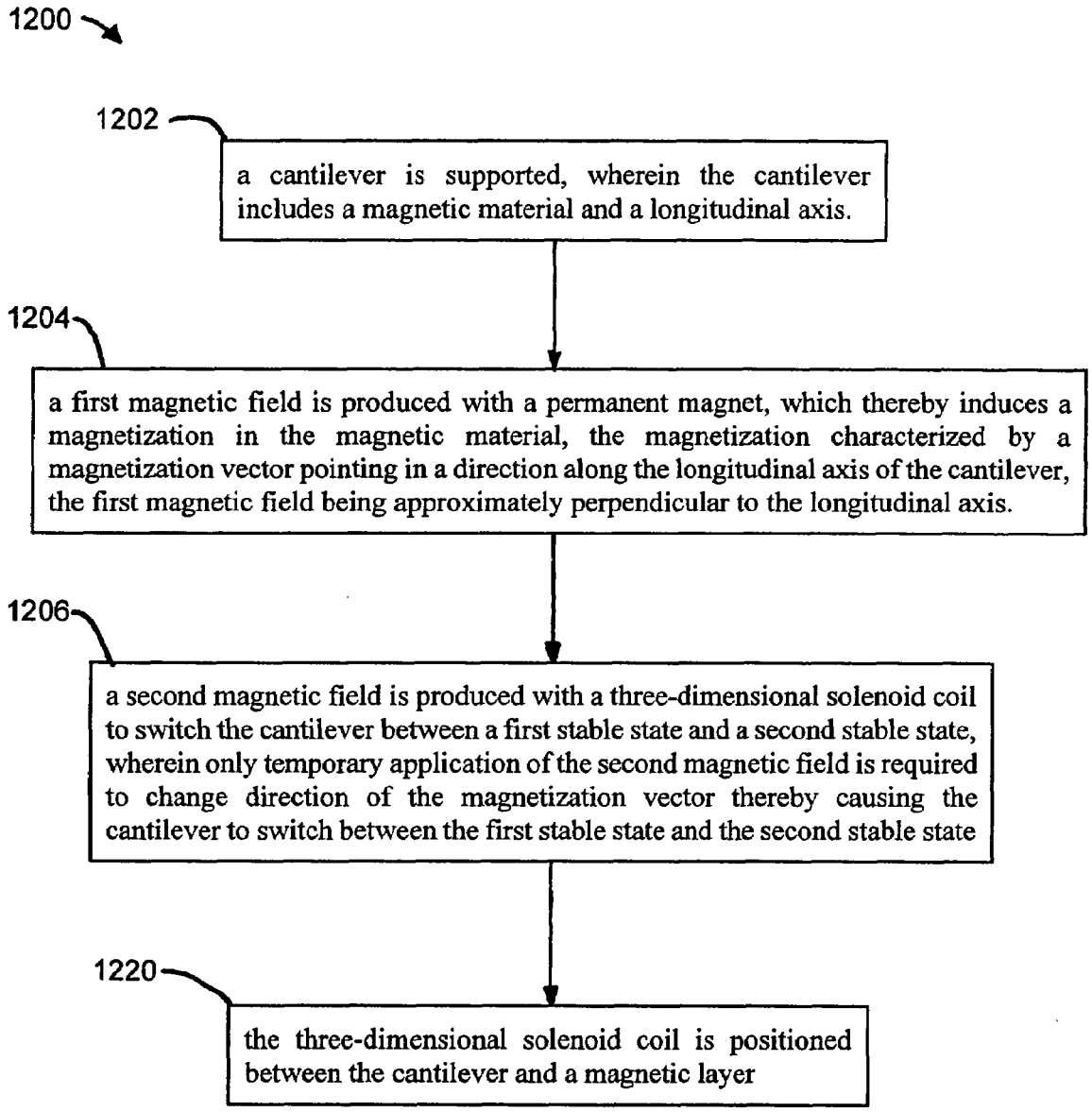

FIG. 12E shows flowchart 1200 with an additional step 1220. In step 1220, the three-dimensional solenoid coil is positioned between the cantilever and a magnetic layer. For example, as shown in FIG. 9, the magnetic layer is magnetic layer 902. As shown in FIG. 9, three-dimensional solenoid coil 500 is positioned between cantilever 112 and magnetic layer 902.

Figure 12F:
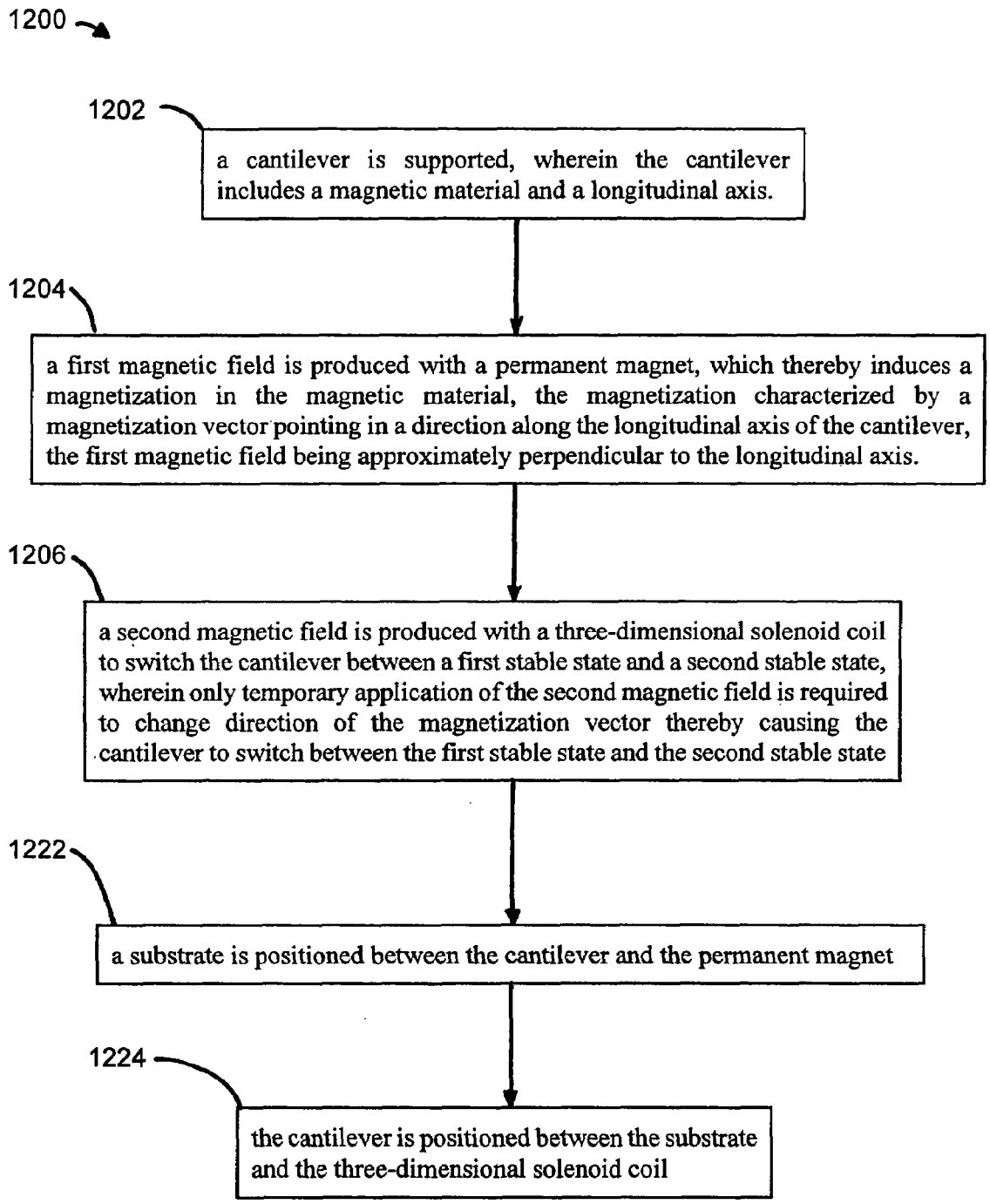

FIG. 12F shows flowchart 1200 with additional steps. In step 1222, a substrate is positioned between the cantilever and the permanent magnet. For example, as shown in FIG. 11, the substrate can be substrate 1102. As shown in FIG. 11, substrate 1102 is positioned between cantilever 112 and magnet 102. Note that in embodiments, three-dimensional solenoid coil 500 can replace and operate as a substrate for switch 800. Furthermore, three-dimensional solenoid coil 500 can be embedded in a substrate of switch 800.

In step 1224, the cantilever is positioned between the substrate and the three-dimensional solenoid coil. For example, as shown in FIG. 11, cantilever 112 is positioned between substrate 1102 and three-dimensional solenoid coil 500. In this embodiment, step 1202 can include the step where the cantilever is supported by the substrate.

Figure 12G:
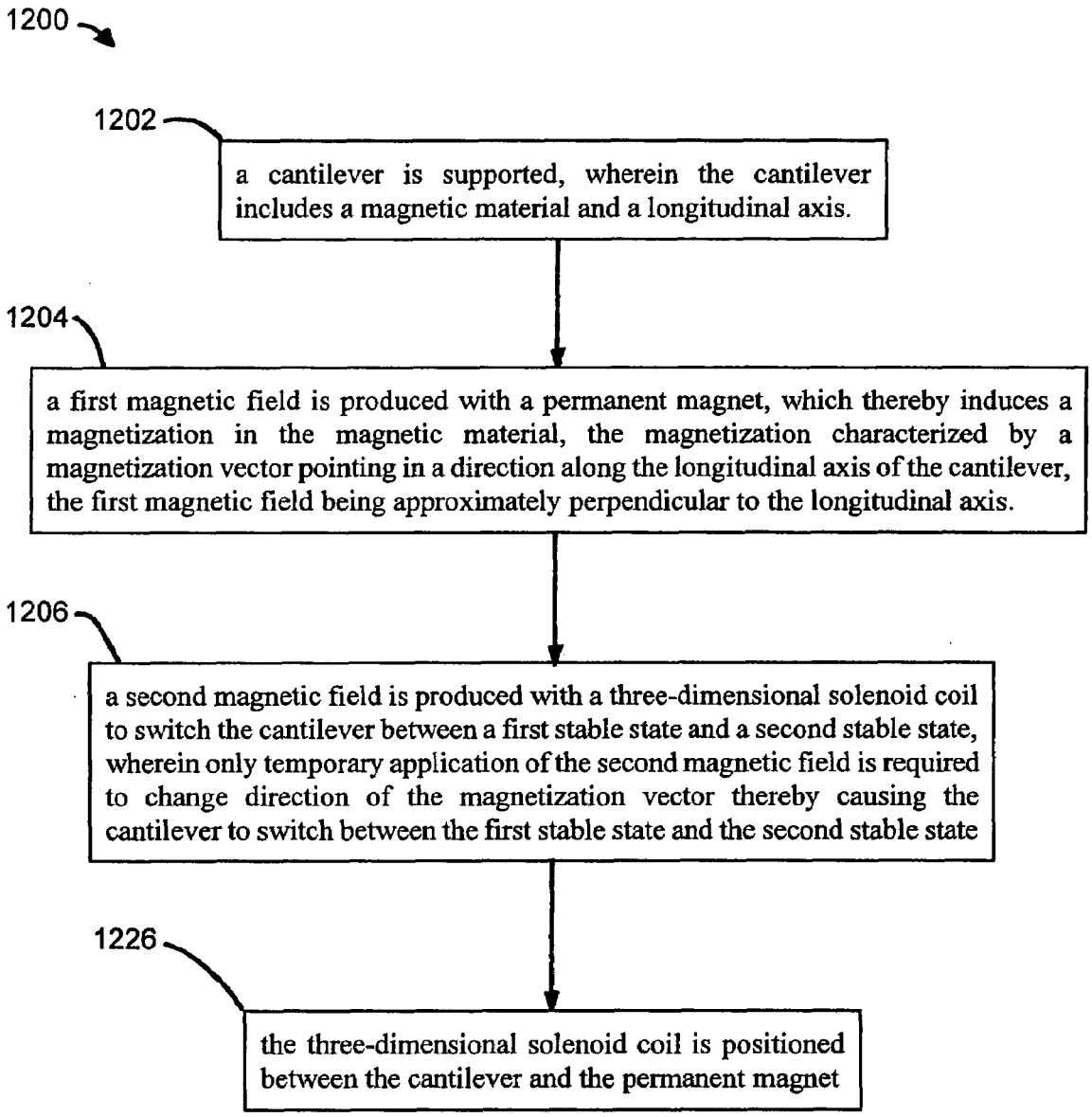

FIG. 12G shows flowchart 1200 with an additional step 1226. In step 1226, the three-dimensional solenoid coil is positioned between the cantilever and the permanent magnet. For example, as shown in FIG. 10, three-dimensional solenoid coil 500 is positioned between cantilever 112 and magnet 102.

Figure 12H:
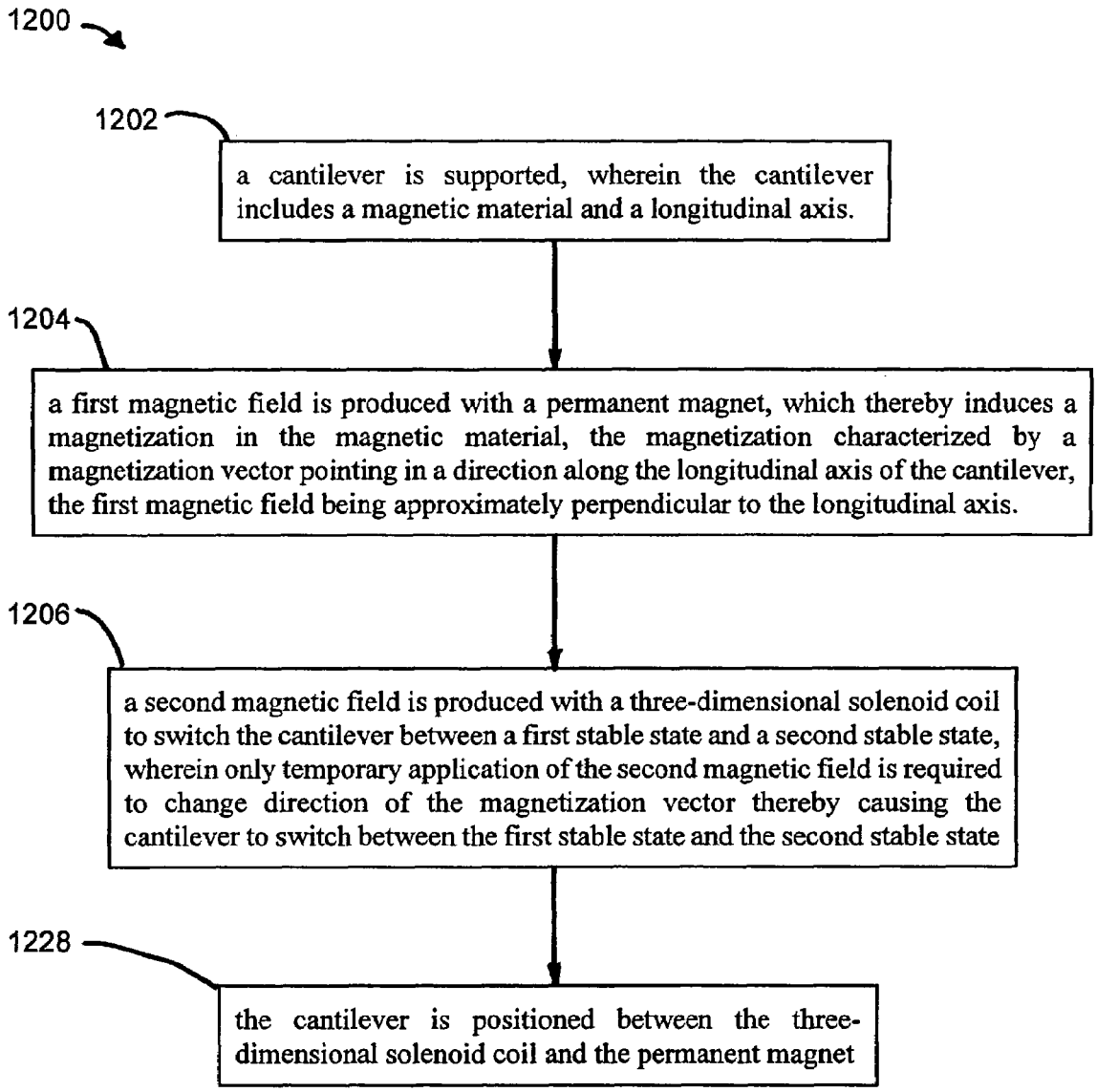

FIG. 12H shows flowchart 1200 with an additional step 1228. In step 1228, the cantilever is positioned between the three-dimensional solenoid coil and the permanent magnet. For example, as shown in FIG. 8B, cantilever 112 is positioned between three-dimensional solenoid coil 500 and magnet 102.

For example, in an embodiment, step 1202 includes the step where the cantilever is supported with an insulator layer of the three-dimensional solenoid coil. For example, as shown in FIG. 8B, cantilever 112 is supported by first insulator layer 506 of three-dimensional solenoid coil 500.

Figure 12I:
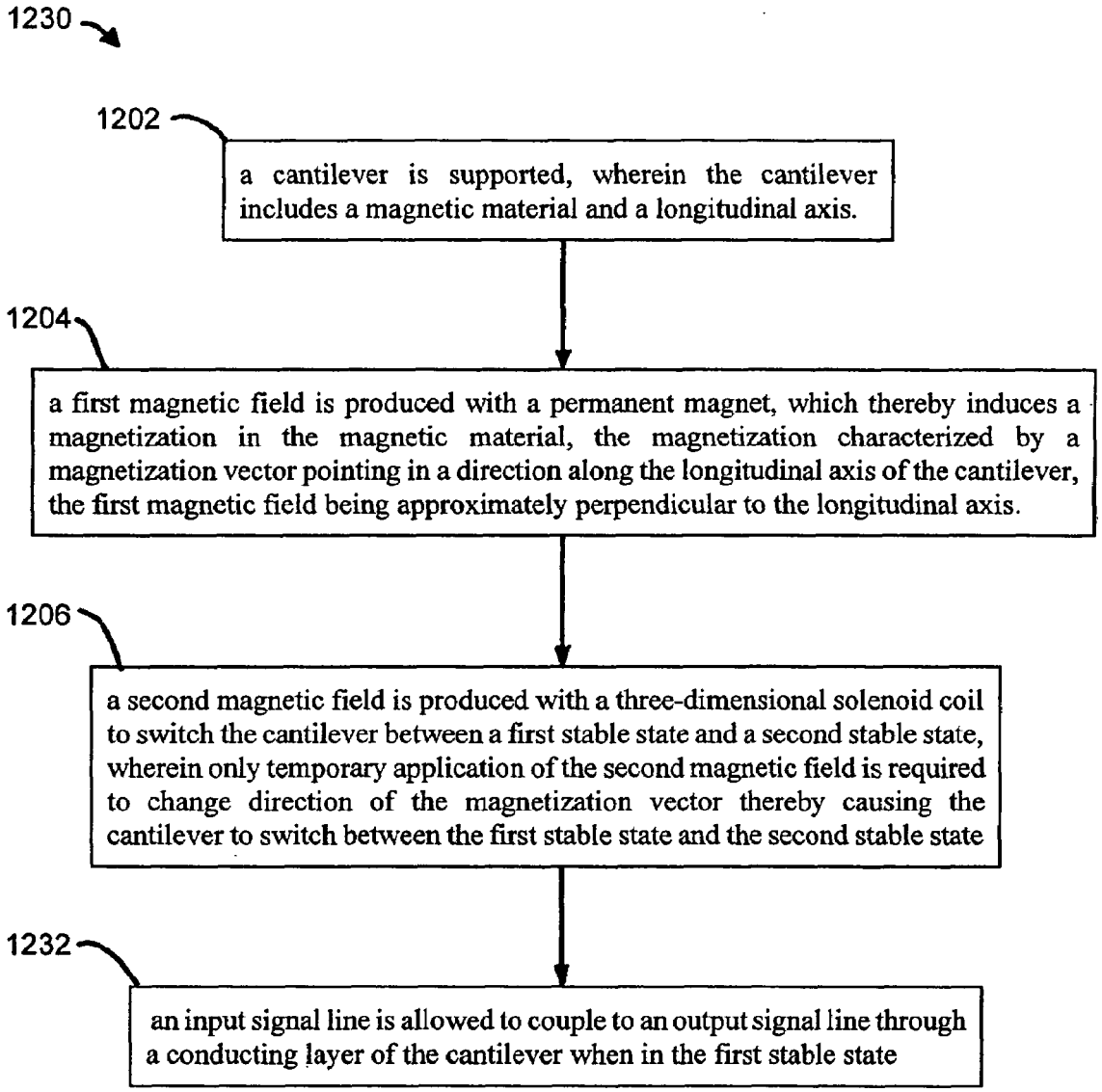

FIG. 12I shows a flowchart 1230 including the steps of flowchart 1200 and an additional step. In step 1232, an input signal line is allowed to couple to an output signal line through a conducting layer of the cantilever when in the first stable state. For example, as described above in relation to FIG. 8B, in a first stable state, cantilever 112 is rotated to the left, and conducting layer 120 of cantilever 112 is allowed to couple first signal input line 812 to first signal output line 814.

Figure 12J:
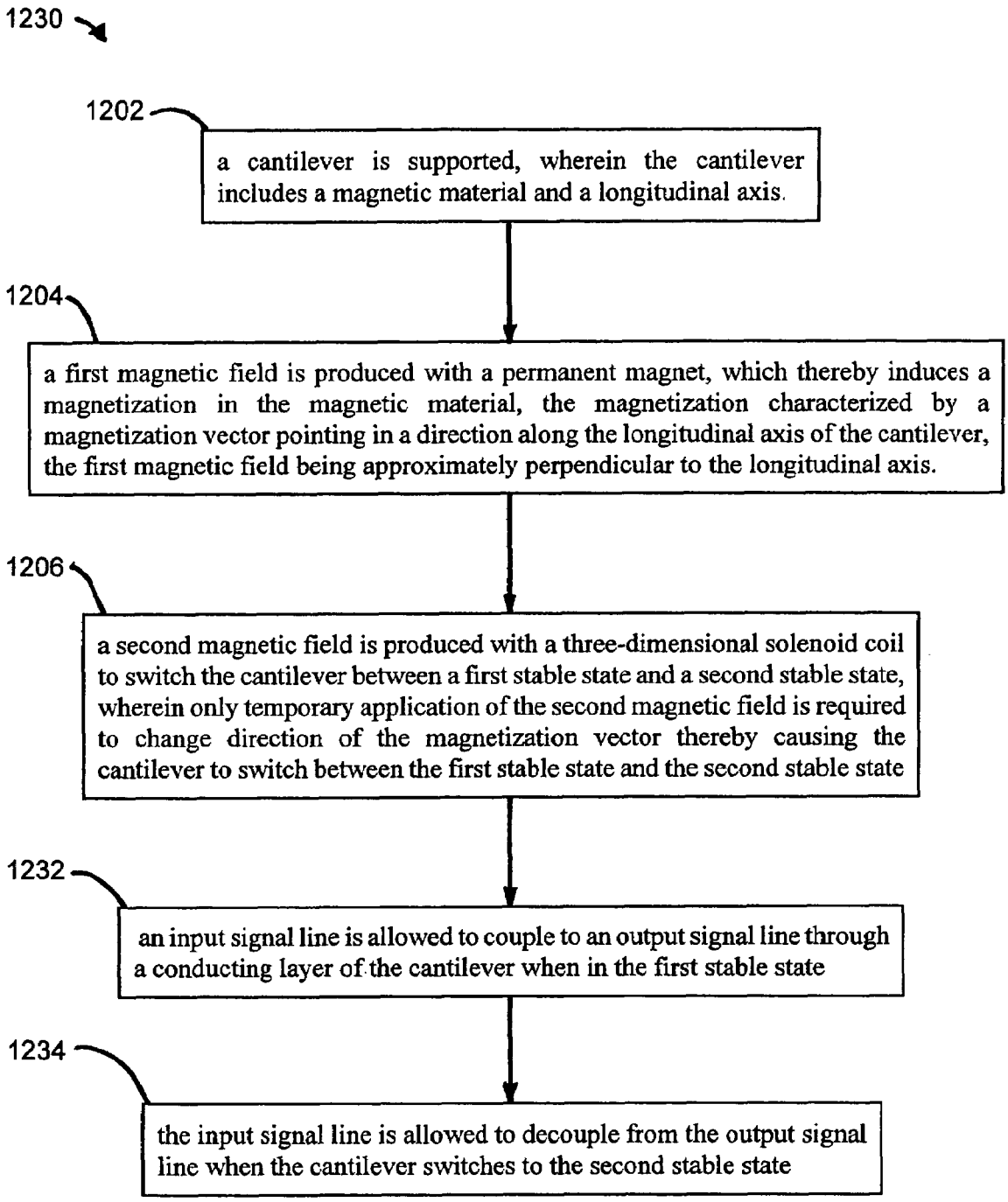

FIG. 12J shows flowchart 1230 of FIG. 12I with an additional step 1234. In step 1234, the input signal line is allowed to decouple from the output signal line when the cantilever switches to the second stable state. For example, as described above with respect to FIG. 8B, in a second stable state, cantilever 112 is rotated to the right, and first signal input line 812 is no longer coupled to first signal output line 814 by conducting layer 120.

Figure 12K:
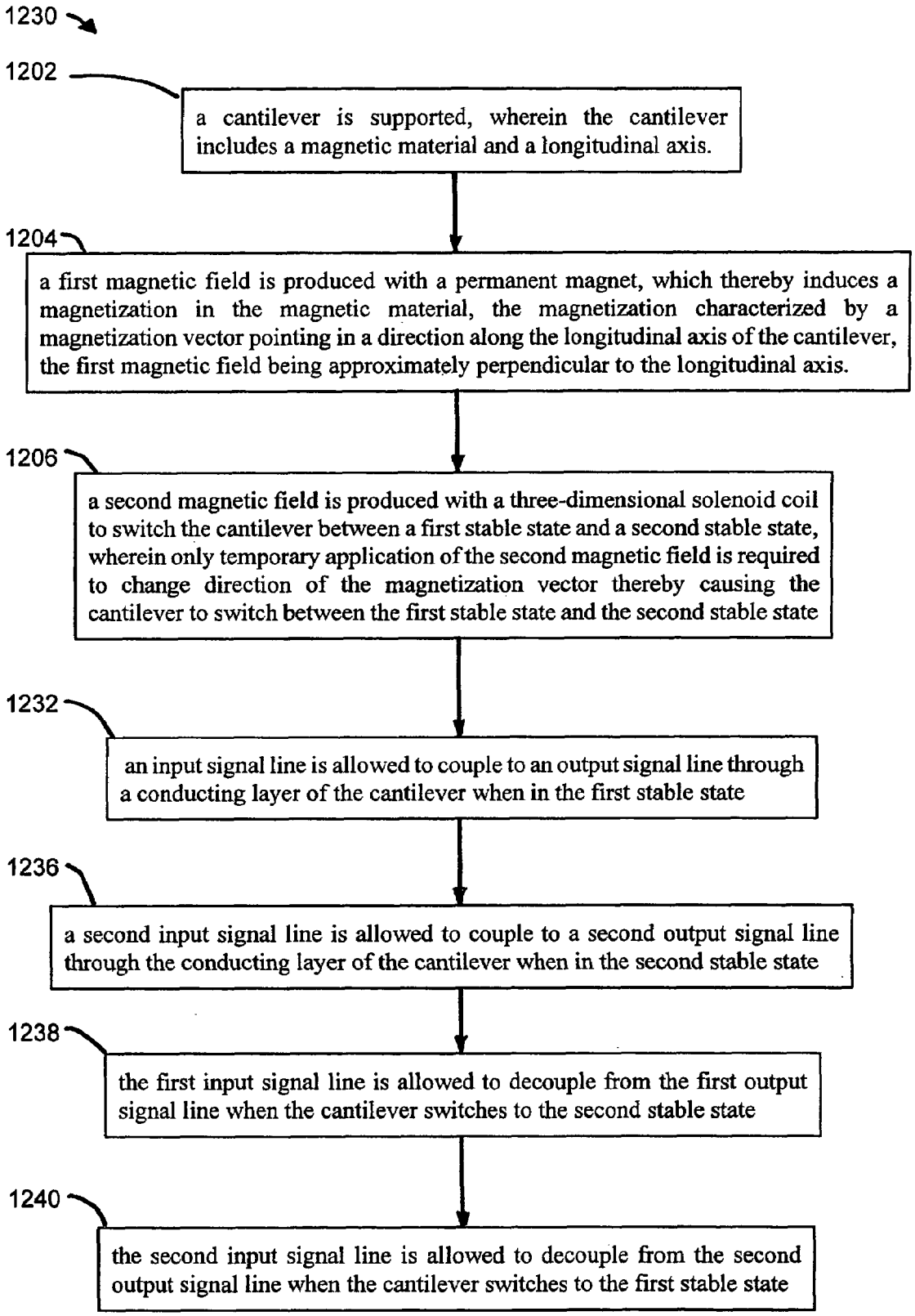

FIG. 12K shows flowchart 1230 of FIG. 12I with additional steps. In step 1236, a second input signal line is allowed to couple to a second output signal line through the conducting layer of the cantilever when in the second stable state. For example, as described above in relation to FIG. 8B, in the second stable state, cantilever 112 is rotated to the right, and conducting layer 120 of cantilever 112 is allowed to couple second signal input line 816 to second signal output line 818.

In step 1238, the first input signal line is allowed to decouple from the first output signal line when the cantilever switches to the second stable state. For example, as described above in relation to FIG. 8B, in the second stable state, cantilever 112 is rotated to the right, and first signal input line 812 is no longer coupled to first signal output line 814 by conducting layer 120.

In step 1240, the second input signal line is allowed to decouple from the second output signal line when the cantilever switches to the first stable state. For example, as described above in relation to FIG. 8B, in the first stable state, cantilever 112 is rotated to the left, and second signal input line 816 is no longer coupled to second signal output line 818 by conducting layer 120.

Figure 12L:
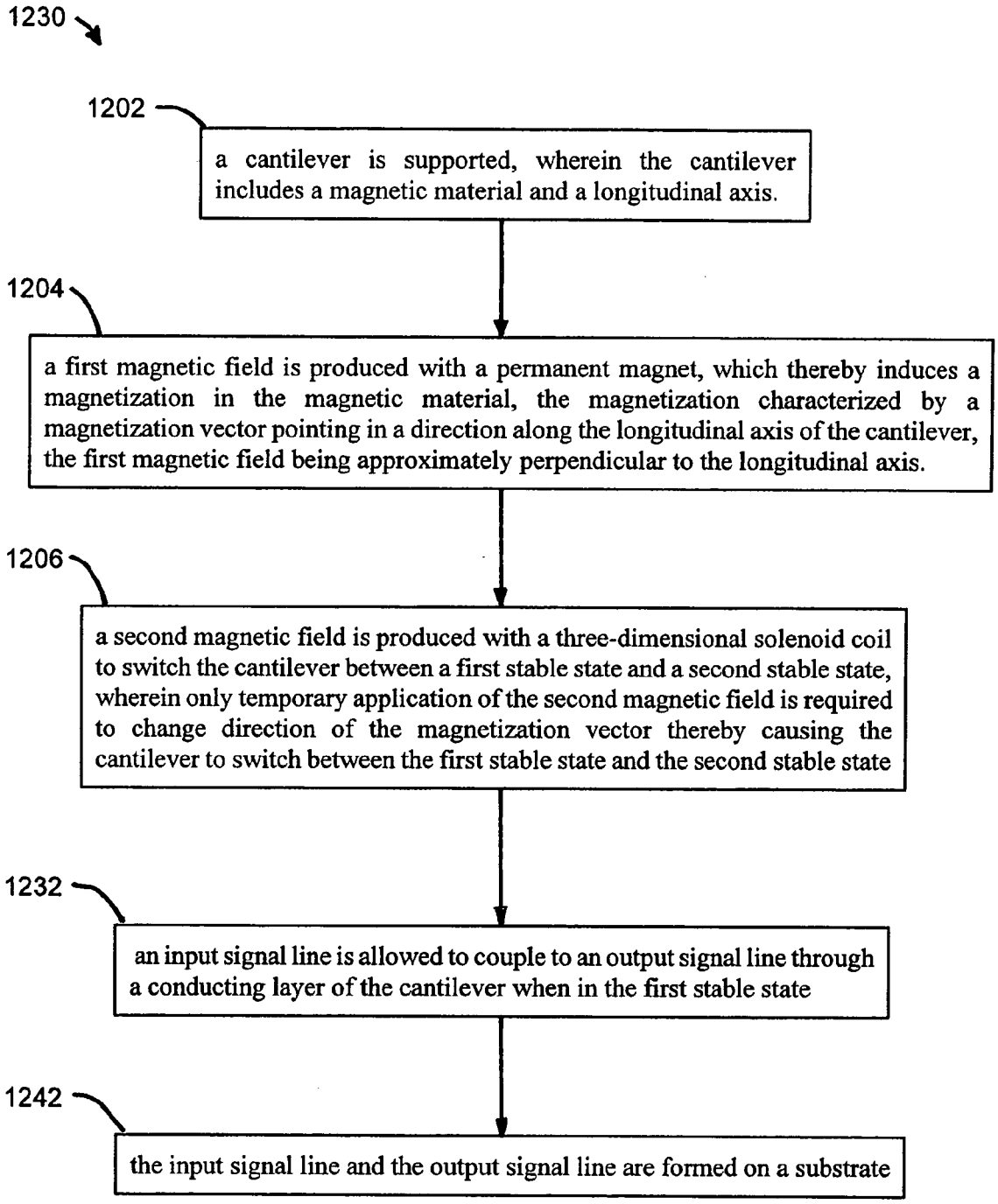

FIG. 12L shows flowchart 1230 of FIG. 12I with an additional step 1242. In step 1242, the input signal line and the output signal line are formed on a substrate. For example, as shown in FIG. 11, output signal line 814 and input signal line 812 (not shown in FIG. 11) are formed on substrate 1102.

Figure 12M:
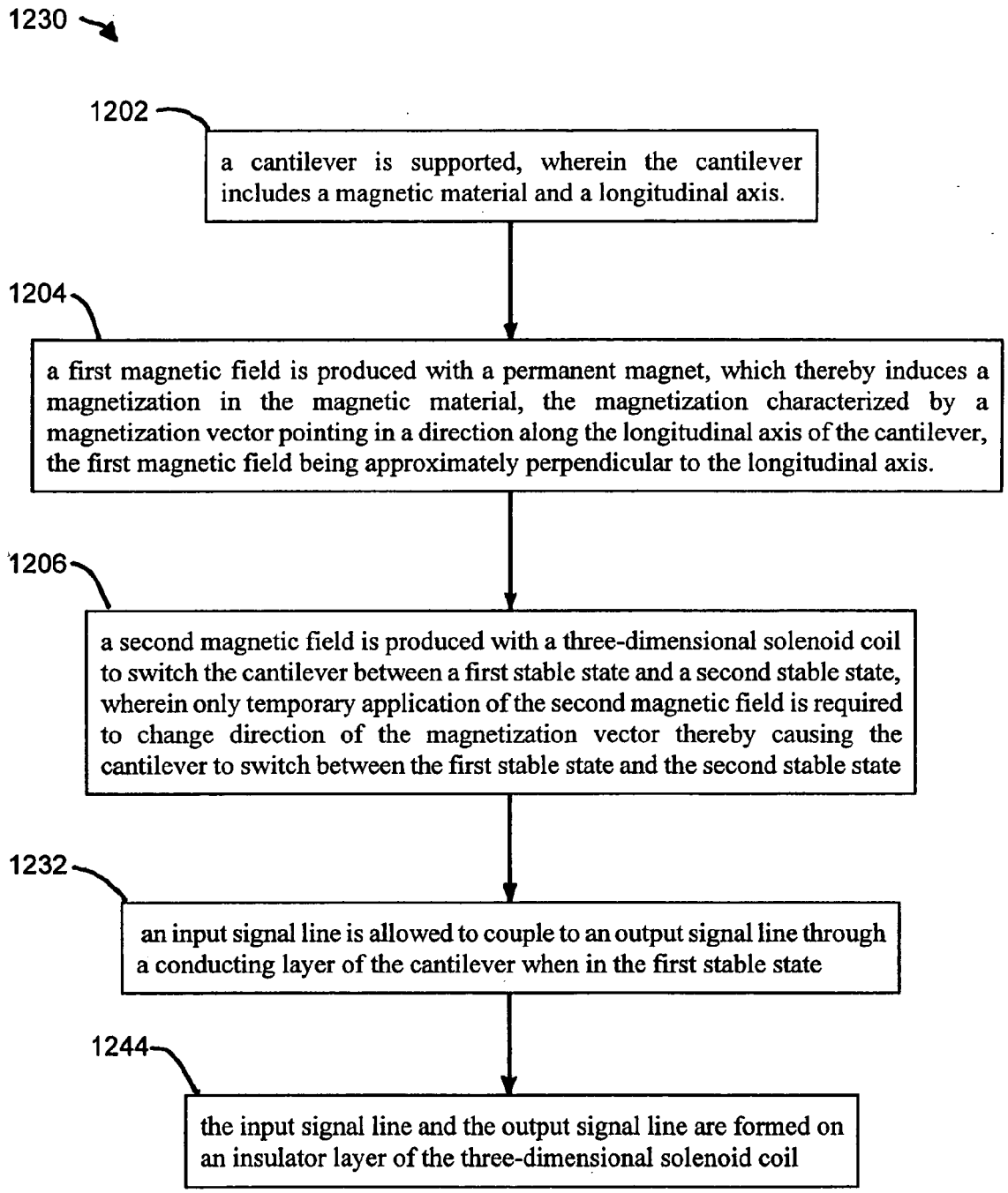

FIG. 12M shows flowchart 1230 of FIG. 12 with an additional step 1244. In step 1244, the input signal line and the output signal line are formed on an insulator layer of the three-dimensional solenoid coil. For example, as shown in FIG. 8A, input signal line 812 and output signal line 814 are formed on first insulator layer 506 of three-dimensional solenoid coil 500.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A micro-machined latching switch, comprising:

a moveable micro-machined cantilever having a magnetic material and a longitudinal axis, wherein said cantilever has a conducting layer;

a permanent magnet producing a first magnetic field, which induces a magnetization in said magnetic material, said magnetization characterized by a magnetization vector pointing in a direction along said longitudinal axis of said cantilever, wherein said first magnetic field is approximately perpendicular to said longitudinal axis; and a three-dimensional solenoid coil producing a second magnetic field to switch said cantilever between a first stable state and a second stable state, wherein a temporary current input to said three-dimensional solenoid coil produces said second magnetic field such that a component of said second magnetic field parallel to said longitudinal axis changes direction of said magnetization vector thereby causing said cantilever to switch between said first stable state and said second stable state including:

a magnetic core, and a coil line wrapped at least once around said magnetic core;

wherein said three-dimensional solenoid coil includes a first layer, a second layer, and a third layer, wherein said magnetic core resides in said second layer between said first layer and said third layer, and wherein said coil line wraps around said magnetic core through said first layer in a first direction and through said second layer in a second direction.

2. The switch of claim 1, wherein said temporary current is input to flow through said coil line around said magnetic core in a first direction to achieve said first stable state, and said temporary current is input to flow through said coil line around said magnetic core in a second direction to achieve said second stable state.

3. The switch of claim 1, wherein said three-dimensional solenoid coil further includes an insulator, wherein said coil line is insulated from said magnetic core by said insulator.

4. The switch of claim 1, wherein said first layer includes a first insulator portion to insulate a portion of said coil line in said first layer; and wherein said third layer includes a second insulator portion to insulate a portion of said coil line in said third layer.

5. The switch of claim 1, wherein said magnetic core is a permalloy.

6. The switch of claim 1, further comprising a magnetic layer, wherein said three-dimensional solenoid coil is positioned between said cantilever and said magnetic layer.

7. The switch of claim 6, wherein said magnetic layer is a permalloy.

8. The switch of claim 1, further comprising:

a substrate;

wherein said cantilever is located between said three-dimensional solenoid coil and said substrate.

9. The switch of claim 8, wherein said substrate is located between said cantilever and said permanent magnet.

10. The switch of claim 8, wherein said cantilever is supported by said substrate.

11. The switch of claim 1, wherein said three-dimensional solenoid coil includes an insulator layer, wherein said cantilever is supported by said insulator layer of said three-dimensional solenoid coil.

12. The switch of claim 11, wherein said cantilever is located between said three-dimensional solenoid coil and said permanent magnet.

13. The switch of claim 1, wherein in said first stable state, said conducting layer couples an input signal line to an output signal line, and wherein in said second stable state, said conducting layer does not couple said input signal line to said output signal line.

14. The switch of claim 13, wherein in said second stable state, said conducting layer couples a second input signal line to a second output signal line;

wherein in said first stable state, said conducting layer does not couple said second input signal line to said second output signal line.

15. The switch of claim 1, wherein said magnetic material is a permalloy.

16. The switch of claim 1, further comprising:

a substrate; and a support mechanism;

wherein said cantilever is supported on said substrate by said support mechanism, wherein said support mechanism includes:

a flexure attached to said cantilever;

a first support stage mounted on said substrate; and a second support stage mounted on said substrate, wherein said flexure is attached between said first support stage and said second support stage.

17. The switch of claim 1, further comprising a support mechanism;

wherein said three-dimensional solenoid coil further includes an insulator layer, wherein said cantilever is supported on said insulator layer by said support mechanism, wherein said support mechanism includes:

a flexure attached to said cantilever;

a first support stage mounted on said insulator layer; and a second support stage mounted on said insulator layer, wherein said flexure is attached between said first support stage and said second support stage.

* * * * *

UNITED STATES PATENT AND TRADEMARK OFFICE

CERTIFICATE OF CORRECTION

PATENT NO. : 7,327,211 B2
APPLICATION NO. : 11/084864
DATED : February 5, 2008
INVENTOR(S) : Ruan et al.

It is certified that error appears in the above-identified patent and that said Letters Patent is hereby corrected as shown below:

Title Page, Item (75), Inventors: replace "Tempe, AZ (US)" replace with --Tempe, AZ (CN)--.

Signed and Sealed this

Fourteenth Day of October, 2008

JON W. DUDAS
*Director of the United States Patent and Trademark Office*